US012071947B2

(12) United States Patent
Lee et al.

(10) Patent No.: US 12,071,947 B2
(45) Date of Patent: Aug. 27, 2024

(54) SCROLL COMPRESSOR

(71) Applicant: LG Electronics Inc., Seoul (KR)

(72) Inventors: Jaesang Lee, Seoul (KR); Sanghun Seong, Seoul (KR); Honghee Park, Seoul (KR); Sooho Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/987,529

(22) Filed: Nov. 15, 2022

(65) Prior Publication Data

US 2023/0193902 A1 Jun. 22, 2023

(30) Foreign Application Priority Data

Dec. 20, 2021 (KR) ..... 10-2021-0182962

(51) Int. Cl.
*F04C 18/02* (2006.01)
*F04C 28/26* (2006.01)
*F04C 29/12* (2006.01)

(52) U.S. Cl.
CPC ..... *F04C 18/0215* (2013.01); *F04C 18/0253* (2013.01); *F04C 18/0261* (2013.01); *F04C 28/26* (2013.01); *F04C 28/265* (2013.01); *F04C 29/12* (2013.01); *F04C 29/128* (2013.01)

(58) Field of Classification Search
CPC ..... F04C 18/0207–0292; F04C 29/12; F04C 29/124; F04C 29/126; F04C 28/26; F04C 28/265
See application file for complete search history.

(56) References Cited

U.S. PATENT DOCUMENTS 6,619,062 B1 * 9/2003 Shibamoto ..... F04C 29/126 62/228.3
2010/0303659 A1 12/2010 Stover et al.
2011/0206548 A1 8/2011 Doepker
(Continued)

FOREIGN PATENT DOCUMENTS

CN 111472977 7/2020
CN 111472977 A * 7/2020
(Continued)

OTHER PUBLICATIONS

Industrial Metal Supply Company, "Differences Between Carbon Steel & Stainless Steel", Apr. 5, 2016, https://www.industrialmetalsupply.com/blog/carbon-steel-vs-stainless-steel (Year: 2016).*
(Continued)

*Primary Examiner* — Mark A Laurenzi
*Assistant Examiner* — Xiaoting Hu
(74) *Attorney, Agent, or Firm* — Fish & Richardson P.C.

(57) ABSTRACT

In a scroll compressor, a discharge chamber is provided in an inner space of a back pressure chamber inner wall, a discharge port is provided inside the discharge chamber, a bypass hole is provided around the discharge port, and a communicating recess portion allowing the discharge chamber to communicate with the bypass hole is provided on an inner circumferential surface of the back pressure chamber inner wall forming the discharge chamber. Through this, the bypass hole may be easily configured in addition to the discharge port, thereby increasing an operation range of the compressor and suppressing overcompression.

16 Claims, 25 Drawing Sheets

(56) References Cited

U.S. PATENT DOCUMENTS

| | | | | |
|---|---|---|---|---|
| 2012/0107163 | A1 | 5/2012 | Monnier et al. | |
| 2012/0107164 | A1* | 5/2012 | Kawano | F04C 28/26 418/55.1 |
| 2014/0271302 | A1* | 9/2014 | Kim | F04C 28/26 418/55.1 |
| 2018/0038370 | A1 | 2/2018 | Doepker et al. | |
| 2019/0128266 | A1* | 5/2019 | Iijima | F04C 28/26 |
| 2019/0242384 | A1* | 8/2019 | Yoo | F04C 18/0261 |
| 2022/0243730 | A1* | 8/2022 | Liu | F04C 18/0215 |

FOREIGN PATENT DOCUMENTS

| | | | | |
|---|---|---|---|---|
| CN | 111980918 | | 11/2020 | |
| JP | 2013-245585 | | 12/2013 | |
| JP | 2013245585 | A * | 12/2013 | F04B 39/04 |
| KR | 20060033268 | A * | 4/2006 | |
| KR | 20100017008 | A * | 2/2010 | |
| KR | 10-2014-0114212 | | 9/2014 | |
| KR | 20140114208 | | 9/2014 | |
| KR | 102155603 | B1 * | 9/2020 | |
| WO | WO-2016056189 | A1 * | 4/2016 | F04B 39/10 |
| WO | WO 2020/238825 | | 12/2020 | |

OTHER PUBLICATIONS

Yaang Pipe Industry, "FCD450-10", https://www.yaang.com/data-center/Carbon-steel/fcd450-10.html (Year: 2023).*

JFE Steel Corporation, "SUS410", https://www.jfe-steel.co.jp/en/products/stainless/jfesus410.php (Year: 2023).*

Extended European Search Report in European Appln No. 22202921.7, dated Apr. 24, 2023, 7 pages.

Office Action in Korean Appln. No.10-2021-0182962, dated Dec. 13, 2022, 8 pages.

* cited by examiner

SCROLL COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2021-0182962, filed on Dec. 20, 2021, the contents of which are incorporated by reference herein in their entirety.

TECHNICAL FIELD

The present disclosure relates to a scroll compressor.

BACKGROUND

A scroll compressor is configured such that an orbiting scroll and a non-orbiting scroll are engaged with each other and a pair of compression chambers is configured between the orbiting scroll and the non-orbiting scroll while the orbiting scroll performs an orbiting motion with respect to the non-orbiting scroll.

The compression chamber includes a suction pressure chamber provided on the outside, an intermediate pressure chamber continuously provided while gradually decreasing in volume from the suction pressure chamber toward the center, and a discharge pressure chamber connected to the center of the intermediate pressure chamber. Normally, the suction pressure chamber is connected to a refrigerant suction pipe through a side surface of the non-orbiting scroll, the intermediate pressure chamber is sealed and connected in multiple stages, and the discharge pressure chamber is connected to the refrigerant discharge pipe through the center of an end plate of the non-orbiting scroll.

In the scroll compressor, as two pairs of compression chambers are provided, the non-orbiting scroll and the orbiting scroll needs to be closely sealed in an axial direction to suppress leakage between the two compression chambers. To this end, the scroll compressor is known to have a back pressure structure in which the orbiting scroll is pressed toward the non-orbiting scroll or, conversely, the non-orbiting scroll is pressed toward the orbiting scroll. The former may be defined as an orbiting back pressure method, and the latter may be defined as a non-orbiting back pressure method (or a fixed back pressure method for convenience).

The orbiting back pressure method is a method in which a back pressure chamber is provided between an orbiting scroll and a main frame supporting the orbiting scroll, and the non-orbiting back pressure method is a method in which a back pressure chamber is provided on a rear surface of the non-orbiting scroll. In particular, the non-orbiting back pressure method may be provided by fastening a separately manufactured back pressure chamber assembly to the rear surface of the non-orbiting scroll.

In general, the orbiting back pressure method is applied to a structure in which the non-orbiting scroll is fixed to the main frame, and the non-orbiting back pressure method is applied to a structure in which the non-orbiting scroll is movable in an axial direction with respect to the main frame. Some scroll compressors use a non-orbiting back pressure method.

In these compressors, an annular back pressure chamber is provided on the back surface of the non-orbiting scroll, and a ring member constituting the upper surface of the back pressure chamber is slidably inserted into the back pressure chamber. Accordingly, the compressors adjust the pressure in the back pressure chamber, while the ring member moves up and down according to the pressure in the back pressure chamber. In addition, a discharge valve for opening and closing a discharge port is installed in a non-orbiting back pressure method. In this case, when the compressor is stopped, the discharge valve blocks a refrigerant flowing back from the discharge chamber to the compression chamber so that the compressor may be rapidly restarted. However, as the back pressure chamber is integrally provided in the non-orbiting scroll, there is no space to install the bypass hole and the bypass valve forming a second discharge port, and overcompression may occur due to non-installation of the bypass hole and the bypass valve to resultantly degrade the efficiency and reliability of the compressor.

In some compressors, a discharge valve and a bypass valve are installed respectively in a non-orbiting back pressure method. The discharge valve may block a back flow of a refrigerant from the discharge chamber to the compression chamber when the compressor is stopped. The bypass valve discharges the refrigerant compressed during overcompression in advance, thereby preventing a decrease in efficiency and reliability of the compressor due to overcompression. However, a separate member such as a back pressure chamber assembly or a hub member is assembled on a rear surface of the non-orbiting scroll. This may lead to an increase in the number of parts and an increase in the assembly process, thereby increasing manufacturing costs.

In some compressors, a bypass hole and a bypass valve are provided through a back pressure chamber inner wall separating a discharge chamber and a back pressure chamber from the rear surface of the non-orbiting scroll. In this case, there is no additional member such as a back pressure chamber assembly or a hub member, so that an increase in manufacturing costs does not occur. However, since the bypass hole has to penetrate up to an upper end of the back pressure chamber inner wall, a length of the bypass hole may be increased, and as a result, overcompression may occur as a refrigerant discharge through the bypass hole is delayed, and as the bypass hole is increased, a dead volume may increase to result in a degradation of an indication efficiency.

SUMMARY

Therefore, the present disclosure describes a scroll compressor in which a bypass hole and a bypass valve for opening and closing the bypass hole are easily provided in the vicinity of a discharge port in a non-orbital back pressure method.

Further, the present disclosure describes a scroll compressor in which a structure for forming a back pressure chamber, while having a bypass hole and a bypass valve penetrating through a rear surface of the non-orbiting scroll, is simplified.

Furthermore, the present disclosure describes a scroll compressor in which the number of parts and assembling man-hours may be reduced by easily providing a bypass hole and a bypass valve, while allowing a portion of a back pressure chamber to be integrally configured in a non-orbiting scroll.

The present disclosure describes a scroll compressor in which a dead volume is minimized, while overcompression is suppressed in a non-orbital back pressure method.

Furthermore, the present disclosure describes a scroll compressor in which a length of a bypass hole is minimized so that an overcompressed refrigerant is rapidly bypassed, while a dead volume is minimized.

Furthermore, the present disclosure describes a scroll compressor in which a bypass valve is easily installed, while a length of the bypass hole is minimized.

In order to achieve these and other advantages and in accordance with the purpose of this specification, as embodied and broadly described herein, there is provided a scroll compressor including an orbiting scroll and a non-orbiting scroll. The orbiting scroll may include an orbiting wrap on one surface of an orbiting end plate and may be coupled to a rotation shaft to perform an orbiting motion. The non-orbiting scroll may include a non-orbiting wrap provided on one surface of the non-orbiting end plate to be engaged with the orbiting wrap to form a compression chamber. A back pressure chamber part having a back pressure chamber may be provided on the other surface of the non-orbiting end plate. A discharge chamber communicating with the compression chamber may be provided inside the back pressure chamber part. In addition, a discharge port connecting the communication chamber to the discharge chamber may be provided in the non-orbiting scroll, and a bypass hole allowing a compression chamber having a pressure lower than that of the compression chamber communicating with the discharge port to communicate with the discharge chamber may be provided around the discharge port. A communicating recess portion connecting the discharge chamber to the bypass hole may be provided on an inner circumferential surface of the discharge chamber. Through this, the bypass hole may be easily provided in addition to the discharge port, thereby increasing an operation range of the compressor and suppressing overcompression.

Here, the communicating recess portion may be configured to extend as a single body from an inner circumferential surface of an inner wall of the back pressure chamber constituting the discharge chamber. Through this, a portion of the back pressure chamber part may be configured as a single body on a rear surface of the non-orbiting end plate, thereby reducing assembly man-hours and easily installing the bypass hole and the bypass valve to lower manufacturing costs. In addition, as a length of the bypass hole is shortened due to the communicating recess portion, a dead volume is reduced, so that the compressor efficiency may be improved.

For example, the communicating recess portion may be configured in an annular shape on an inner circumferential surface of the back pressure chamber inner wall constituting the discharge chamber. An outer diameter of the communicating recess portion may be greater than an inner diameter of the back pressure chamber inner wall. Through this, as a plurality of bypass holes communicate with one communicating recess portion, machining of the communicating recess portion may be facilitated.

Specifically, a back pressure hole allowing the compression chamber and the back pressure chamber to communicate with each other may be provided in the non-orbiting end plate. The back pressure hole may be located on an outer side than the communicating recess portion. Through this, while the communicating recess portion is configured in an annular shape, the back pressure chamber is smoothly provided by preventing interference with the back pressure hole, thereby effectively suppressing refrigerant leakage between the orbiting scroll and the non-orbiting scroll.

As another example, the communicating recess portion may be configured linearly on an inner circumferential surface of the back pressure chamber inner wall constituting the discharge chamber. The communicating recess portion may be configured to penetrate through between an outer circumferential surface of the non-orbiting scroll and an inner circumferential surface of the back pressure chamber inner wall. Through this, the communicating recess portion may not only be easily machined but also form a communicating recess portion deeply if necessary.

Specifically, a back pressure hole connecting the compression chamber and the back pressure chamber may be provided in the non-orbiting end plate. The back pressure hole may be provided on one side of the communicating recess portion in the circumferential direction. Through this, the communicating recess portion may be easily provided, while avoiding interference with the back pressure hole.

As another example, a back pressure chamber outer wall and the back pressure chamber inner wall constituting the back pressure chamber may extend from the other surface of the non-orbiting end plate. The bypass hole may be provided on the opposite side of the discharge port with respect to an inner circumferential surface of the back pressure chamber inner wall. Through this, as the back pressure chamber inner wall is sufficiently spaced apart from the back pressure hole, the degree of freedom in designing the position of the back pressure hole may be increased.

Specifically, a floating plate may be further provided to cover a portion between the back pressure chamber outer wall and the back pressure chamber inner wall to form the back pressure chamber between the back pressure chamber outer wall and the back pressure chamber inner wall. The floating plate may include an upper cover portion, an outer cover portion, and an inner cover portion. The upper cover portion may be provided in an annular shape to form an upper surface of the back pressure chamber. The outer cover portion may extend from an outer periphery of the upper cover portion in an axial direction toward the non-orbiting scroll. The inner cover portion may extend from an inner periphery of the upper cover portion in an axial direction toward the non-orbiting scroll. The inner circumferential surface of the inner cover portion may be slidably inserted into an outer circumferential surface of the back pressure chamber inner wall. Through this, it is possible to stably secure sealing force of the back pressure chamber by inserting the sealing member into the floating plate having a high degree of design freedom for the shape of the floating plate and relatively high machining roughness.

As another example, the back pressure chamber outer wall and the back pressure chamber inner wall constituting the back pressure chamber may extend from the other surface of the non-orbiting end plate. At least a portion of the bypass hole may be provided between an inner circumferential surface of the back pressure chamber inner wall and the discharge port. Through this, as the inner wall of the back pressure chamber is pushed outward, a cross-sectional area of the discharge chamber may be increased, and thus, the communicating recess portion may be configured shallow in a radial direction, so that the communicating recess portion may be easily machined.

Specifically, a floating plate may be further provided to cover a portion between the back pressure chamber outer wall and the back pressure chamber inner wall to form the back pressure chamber between the back pressure chamber outer wall and the back pressure chamber inner wall. The floating plate may include an upper cover portion, an outer cover portion, and an inner cover portion. The upper cover portion may be configured in an annular shape to form an upper surface of the back pressure chamber. The outer cover portion may extend from an outer periphery of the upper cover portion in an axial direction toward the non-orbiting scroll. The inner cover portion may extend from an inner periphery of the upper cover portion in an axial direction toward the non-orbiting scroll. The outer circumferential surface of the inner cover portion may be slidably inserted into the inner circumferential surface of the back pressure chamber inner wall. Through this, a cross-sectional area of the back pressure chamber may be secured while the inner wall of the back pressure chamber is pushed outward. In addition, since the thickness of the floating plate is configured to be thin, the weight of the floating plate as a whole is reduced, and a portion between a low-pressure part and a high-pressure part may be rapidly blocked.

As another example, a bypass valve may be provided in the non-orbiting end plate to open and close the bypass hole according to a pressure difference between the compression chamber and the discharge chamber. One end of the bypass valve may be fixed to the non-orbiting end plate on an inner side than the inner circumferential surface of the discharge chamber. At least a portion of the other end of the bypass valve may be inserted into the communicating recess portion to open and close the bypass hole. Through this, the bypass valve may be easily installed while forming the communicating recess portion, and the selection range for the bypass valve is wide so that overcompression may be more effectively suppressed by applying an appropriate bypass valve.

As another example, a bypass valve for opening and closing the bypass hole may be provided inside the bypass hole. Through this, the bypass valve may be easily installed in the communicating recess portion regardless of the shape. In addition, as the bypass valve is inserted into the bypass hole, an actual length of the bypass hole may be reduced to suppress a dead volume. In addition, the space utilization of the discharge chamber around the discharge port may be increased to extend the operation range of the compressor by additionally installing a bypass valve.

Specifically, one end of the bypass valve facing the compression chamber may be provided to face an axial cross-section of the orbiting wrap in an axial direction between the non-orbiting wraps facing each other. Through this, while the bypass valve is inserted into the bypass hole, the bypass valve, may be simply and stably supported, thereby increasing the reliability of the bypass valve.

In addition, at least a portion of an outer circumferential surface of the bypass valve may be configured to have the same curve as that of a main surface of the non-orbiting wrap. Through this, the bypass hole may be configured as close to the wrap as possible, thereby maximally securing the size of the bypass hole. Further, even when a plurality of bypass holes communicating with one compression chamber are provided, these bypass holes may be opened and closed by a single bypass valve.

In addition, a radial length of the bypass valve may be provided to be the same as an inter-wrap distance defined by an interval between the main surfaces of both non-orbiting wraps facing each other in the radial direction. Through this, a cross-sectional area of the bypass valve may be maximized to secure a press-fitting area of the bypass valve to the maximum, and at the same time, an overlapping area with the orbiting scroll may be maximized, thereby stably fixing the bypass valve.

In addition, the bypass valve may include a fixed member and a valve member. The fixed member may be inserted into the bypass hole. The valve member may be located between the fixed member and the communicating recess portion and may be detachably attached to the fixed member while moving in the axial direction according to a pressure difference between the compression chamber and the discharge chamber to selectively open and close the bypass hole. A fixed discharge passage penetrating between both side surfaces in the axial direction may be provided in the fixed member. A valve discharge passage may be provided in the valve member to selectively communicate with the fixed discharge passage. Through this, the configuration of the bypass valve inserted into the bypass hole may be simplified and the bypass hole may be stably opened and closed to effectively suppress overcompression of the compression chamber.

Specifically, the fixed discharge passage may include a fixed discharge port and a fixed discharge recess. One end of the fixed discharge port may be open toward the compression chamber and at least one or more of the fixed discharge ports may be provided to penetrate through the fixed member in the axial direction. The fixed discharge recess may be depressed by a preset depth in the axial direction on one surface of the fixed member facing the valve member. The other end of the fixed discharge port may communicate with the fixed discharge recess and may be opened and closed by the valve member. Through this, the structure of the bypass valve may be simplified by unifying the bypass passage of the fixed member constituting the substantial bypass hole.

Furthermore, a plurality of the fixed discharge ports may be provided at preset intervals along the main surface of the non-orbiting wrap. One fixed discharge recess may be provided in an annular shape. Each of the plurality of fixed discharge ports may communicate with the one fixed discharge recess. Through this, even if the bypass hole communicating with one compression chamber is provided of a plurality of holes, the bypass passage may be unified to simplify the structure of the bypass valve.

Furthermore, in the fixed member, an opening/closing protrusion for opening and closing the valve discharge passage may be provided on the same axial line as the valve discharge passage. The opening/closing protrusion may protrude to have the same height as one surface of the fixed member facing the valve member inside the fixed discharge recess. Through this, even if the bypass valve includes the fixed member and the valve member the bypass valve may effectively open and close the bypass passage constituting the substantial bypass hole.

Specifically, the valve discharge passage may include a valve discharge port and a valve discharge recess. The valve discharge port may penetrate from one side of the valve member facing the fixed member to the other side of the valve member. The valve discharge recess may extend from the valve discharge port to the outer circumferential surface of the valve member toward the discharge chamber. Through this, the structure of the bypass valve may be simplified by unifying the bypass passage of the valve member constituting the substantial bypass hole.

Furthermore, the valve discharge recess may be depressed by a preset depth in the axial direction from the other side of the valve member. Through this, the refrigerant in the compression chamber may be smoothly bypassed into the discharge chamber even in a state in which the valve member rises to be in close contact with the communicating recess portion. In addition, while the fixed discharge recess forms a kind of pressing recess, the valve member may quickly block the bypass passage forming the substantial bypass hole, thereby suppressing the refrigerant in the discharge chamber from flowing back into the compression chamber.

Further, an axial thickness of the valve member may be provided to be greater than or equal to an axial height of the communicating recess portion. Through this, it is possible to suppress the valve member constituting the bypass valve from being separated from the bypass hole.

In addition, the fixed member may be provided of a material having a thermal expansion coefficient greater than or equal to that of the non-orbiting scroll, and the valve member may be provided of a material having a lower thermal expansion coefficient and being lighter than those of the fixed member. Through this, the separation of the fixed member from the non-orbiting scroll during an operation of the compressor may be suppressed, while thermal deformation and weight of the valve member may be reduced, so that the bypass passage forming the substantial bypass hole of the valve member may be opened more quickly.

In addition, the bypass valve may include a fixed member and a valve member. The fixed member may be inserted into the bypass hole to be fixed. The valve member may be located between the fixed member and the communicating recess portion. The valve member may be detachably attached to the fixed member while moving in an axial direction according to a pressure difference between the compression chamber and the discharge chamber to selectively open and close the bypass hole. A fixed discharge passage penetrating between both side surfaces in the axial direction may be provided in the fixed member. The valve member may have an axial thickness smaller than an axial height of the communicating recess portion. Through this, a response speed of the bypass valve may be increased by reducing the weight of the valve member. As a result, the valve member may be quickly opened and closed to effectively suppress overcompression or backflow.

Specifically, the fixed discharge passage may include a fixed discharge port and a fixed discharge recess. The fixed discharge port is provided as at least one penetrating the fixed member in the axial direction. The fixed discharge recess may be depressed by a preset depth in the axial direction on one side of the fixed member facing the valve member. The fixed discharge recess may communicate with the other end of the fixed discharge port to be opened and closed by the valve member. The fixed discharge port may be provided in plurality, and the plurality of fixed discharge ports may be provided at preset intervals along a main surface of the non-orbiting wrap. The fixed discharge recess may be provided as one in a circular shape and communicate with each of the plurality of fixed discharge ports. Through this, the structure of the fixed member may be simplified so that the bypass valve may be easily manufactured and the operation reliability may be increased.

In addition, the valve member may have a pressing recess that is depressed by a preset depth toward the discharge chamber on the other side opposite to one side facing the fixed member. Through this, it is possible to quickly block the bypass passage constituting the substantial bypass hole, thereby suppressing the refrigerant from the discharge chamber from flowing back into the compression chamber.

In addition, the valve member may include an elastic member on the other side opposite to one side facing the fixed member so as to elastically support the valve member toward the fixed member. Through this, it is possible to quickly block the bypass passage constituting the substantial bypass hole, thereby suppressing the refrigerant from the discharge chamber from flowing back into the compression chamber.

In addition, the fixed member may be provided of a material having a thermal expansion coefficient greater than or equal to that of the non-orbiting scroll, and the valve member may be provided of a material having a lower thermal expansion coefficient and being lighter than those of the fixed member. Through this, it is possible to suppress the separation of the fixed member from the non-orbiting scroll during an operation of the compressor, while the thermal deformation and weight of the valve member may be reduced, so that the bypass passage forming the substantial bypass hole of the valve member may be opened more quickly.

As another example, the communicating recess portion may penetrate through the discharge chamber from the outer circumferential surface of the non-orbiting scroll. A bypass valve may be inserted and coupled to the communicating recess portion to open and close the bypass hole according to a pressure difference between the compression chamber and the discharge chamber. Through this, as the bypass valve is installed outside the bypass hole, the bypass valve may be more easily installed. In addition, while the bypass hole is provided to penetrate through in the radial direction, an outer portion of the bypass hole may be sealed using the bypass valve, so that manufacturing costs may be lowered by excluding a separate stopper member.

Specifically, the bypass valve may include a fixed member and a valve member. One end of the fixed member may form a fixed portion inserted into the communicating recess portion to be fixed therein, and the other end may be spaced apart from the bypass hole by a preset distance to form a retainer portion. One end of the valve member forms a fixed end portion fixed in the middle of the fixed member, and the other end may form an opening and closing end portion opening and closing the bypass hole, while rotating about the fixed end portion between the bypass hole and the retainer portion of the fixed member. Through this, the bypass valve may be modularized and the bypass valve may be easily installed. In addition, as the valve member is provided of a reed valve having elasticity, not only a valve response speed but also the operation reliability may be improved.

Furthermore, the valve accommodating portion in which the valve member is accommodated may be provided to be stepped on one side of the fixed member so that one end of the valve member may be coupled to the valve accommodating portion of the fixed member. A valve fixed protrusion may be provided at the valve accommodating portion, and a valve fixing hole may be provided in the valve member so that the valve fixed protrusion may be inserted therein. Through this, as the fixed end of the valve member is coupled to the fixed member, distortion of the valve member may be suppressed, thereby further improving the operation reliability of the valve.

In addition, in order to achieve the object of the present disclosure, a rotation shaft, an orbiting scroll, and a non-orbiting scroll may be included. The rotation shaft may transmit a rotational force of the drive motor to the orbiting scroll. The orbiting scroll may include an orbiting wrap on one surface of the orbiting end plate, and may be coupled to the rotation shaft to perform an orbiting motion. In the non-orbiting scroll, a non-orbiting wrap engaged with the orbiting wrap to form a compression chamber may be provided on one surface of the non-orbiting end plate, and a back pressure chamber part may be provided on the other surface of the non-orbiting end plate. A discharge port may be provided in the non-orbiting scroll to connect the compression chamber to a discharge chamber provided by an inner space of the back pressure chamber inner wall, and a bypass hole connecting the compression chamber having a pressure lower than that of the compression chamber communicating with the discharge port to the discharge chamber may be provided in the vicinity of the discharge port. A bypass valve for opening and closing the bypass hole may be inserted into the bypass hole and coupled thereto. Through this, assembling of the bypass valve may be facilitated and a length of the bypass hole may be reduced to reduce a dead volume.

BRIEF DESCRIPTION OF THE DRAWINGS

FIG. 6 is a plan view showing another embodiment of a back pressure chamber part in

FIG. 2;

FIGS. 12 and 13 are cross-sectional views showing an operation of a bypass valve in

FIG. 8;

DETAILED DESCRIPTION

Hereinafter, a scroll compressor according to the present disclosure will be described in detail based on an embodiment shown in the accompanying drawings.

In general, scroll compressors, like other compressors, are classified into low-pressure compressors and high-pressure compressors depending on which pressure portion is provided by an inner space of a casing, particularly, a space accommodating a motor unit. In the former case, the space forms a low-pressure part, in which a refrigerant suction pipe communicates with the space, and in the latter case, the space forms a high-pressure part, in which the refrigerant suction pipe penetrates through the casing to be directly connected to a compression portion. This embodiment relates to a low-pressure scroll compressor.

In addition, the scroll compressor may be divided into a vertical scroll compressor in which a rotation shaft is disposed perpendicular to the ground and a horizontal scroll compressor in which a rotation shaft is disposed parallel to the ground. For example, in the vertical scroll compressor, an upper side may be defined as a side opposite to the ground and a lower side may be defined as a side facing the ground. Hereinafter, the vertical scroll compressor will be described as an example. However, the present embodiment may also be applied equally or similarly to the horizontal scroll compressor. Therefore, in the following, an axial direction may be understood as an axial direction of the rotation shaft, and a radial direction may be understood as a radial direction of the rotation shaft. An axial direction may be understood as a vertical direction, the radial direction may be understood as left and right side surfaces, an inner circumferential surface may be understood as an upper surface, and an axial radial direction may be understood as a side surface, respectively.

Figure 1:
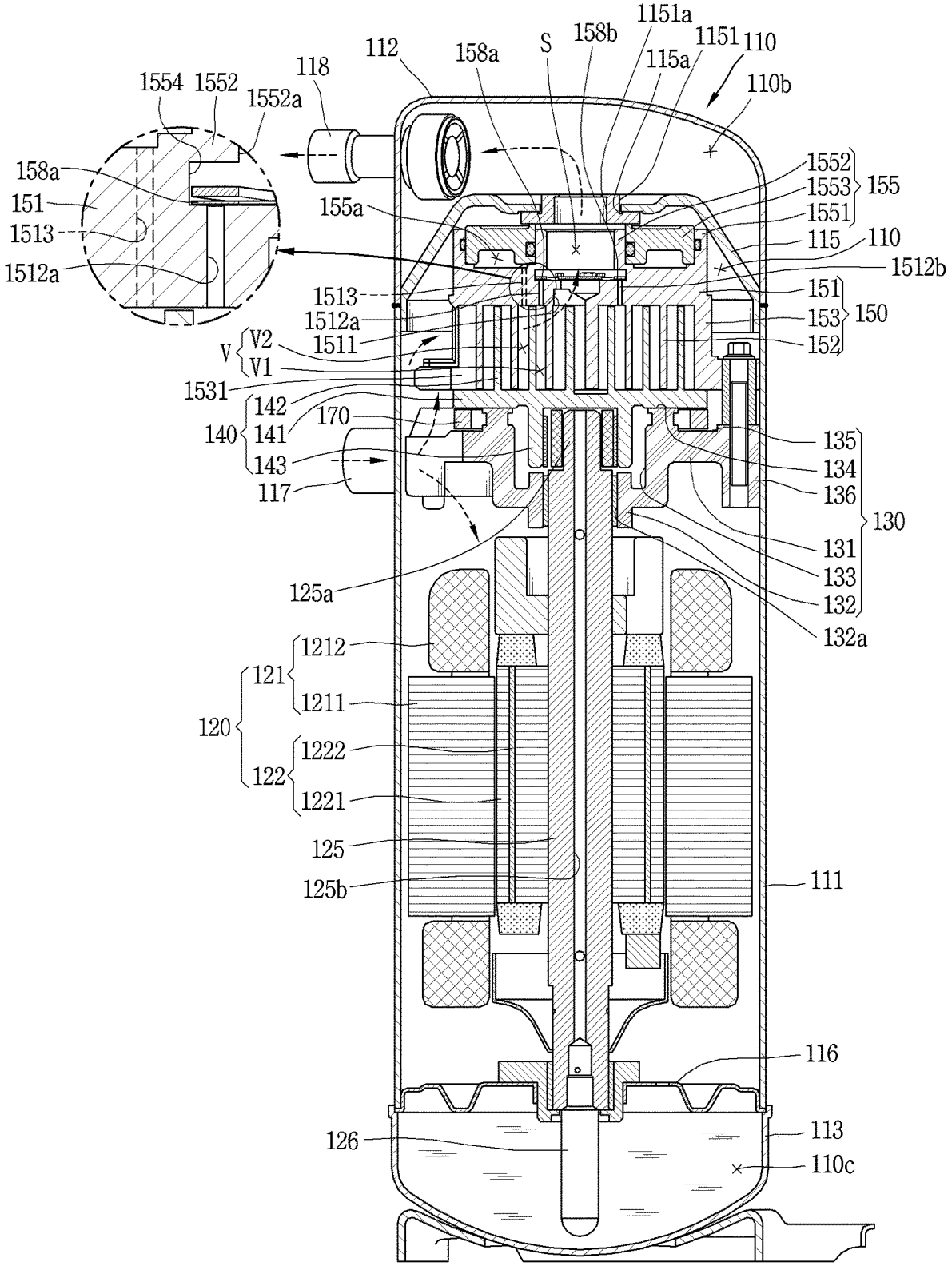
FIG. 1 is a longitudinal cross-sectional view showing the inside of a capacity-variable scroll compressor according to the present embodiment.
Figure 2:
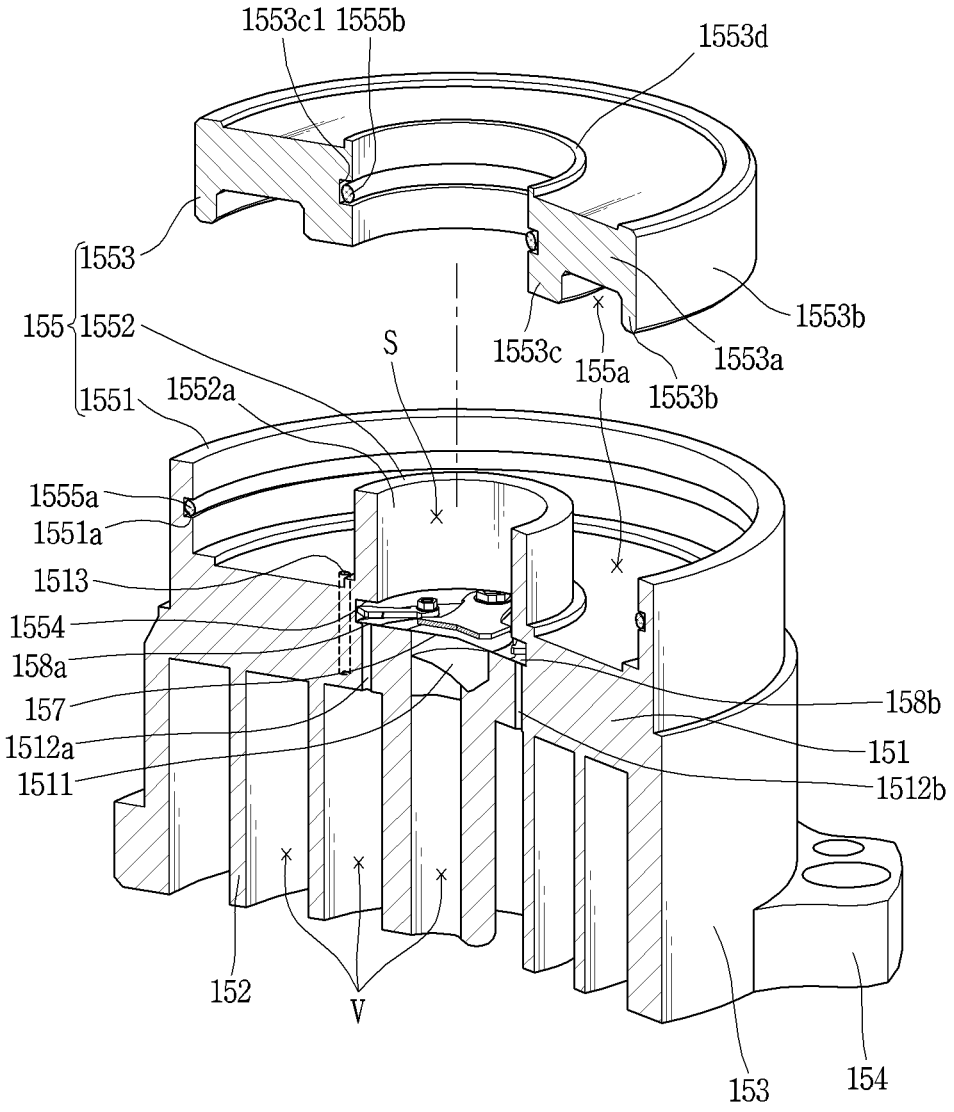
FIG. 2 is an exploded perspective view of a back pressure chamber part provided in a non-orbiting scroll in FIG. 1.
Figure 3:
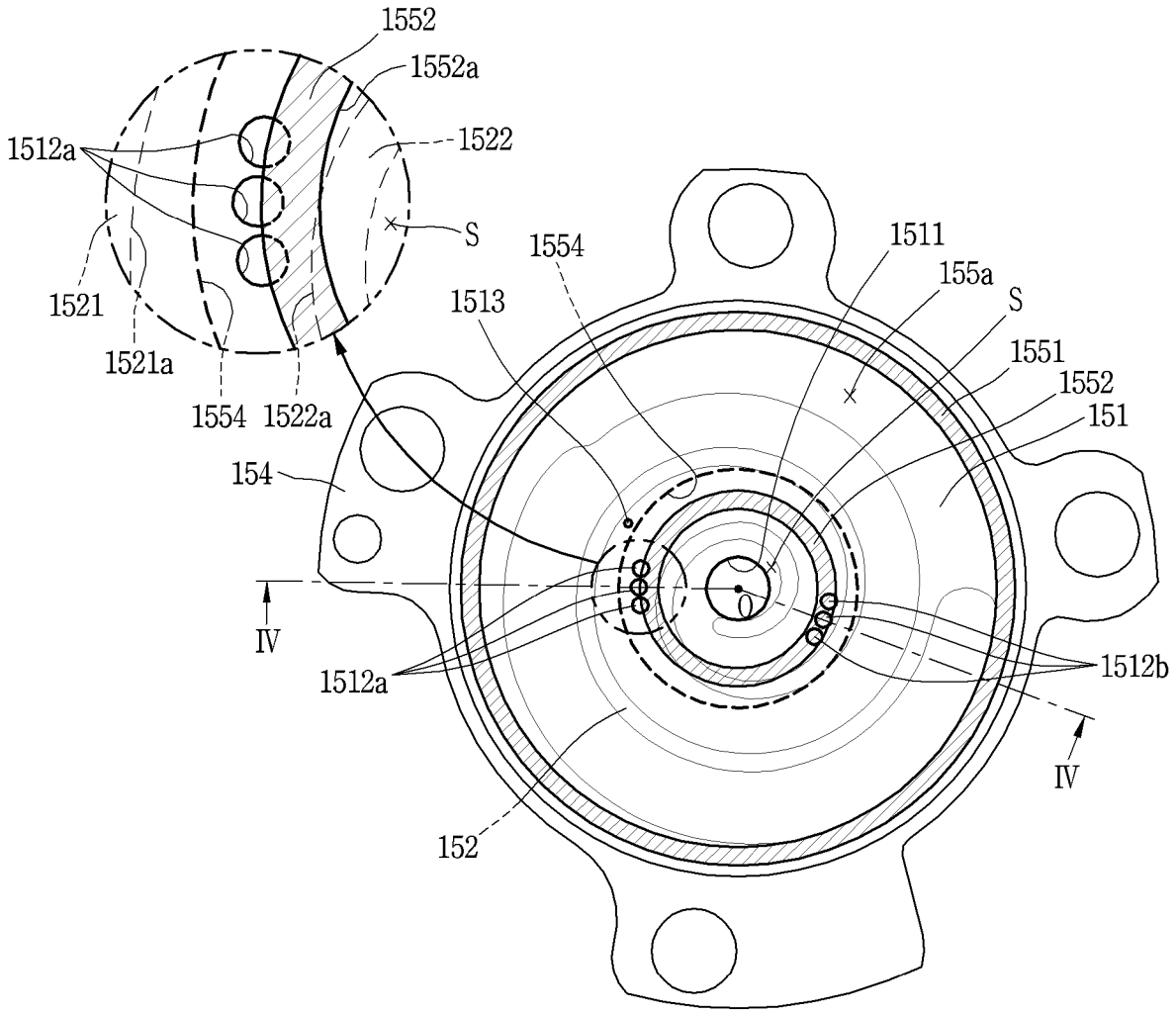
FIG. 3 is a plan view of FIG. 2.
Figure 4:
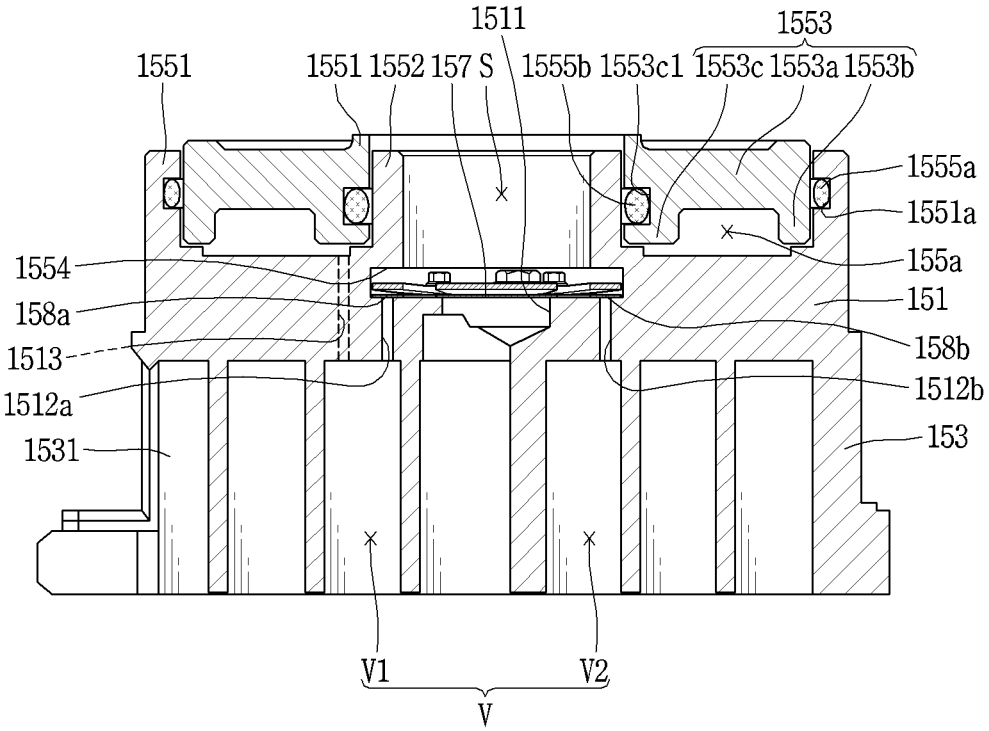
FIG. 4 is a cross-sectional view taken along line "IV-IV" of FIG. 3.
Figure 5:
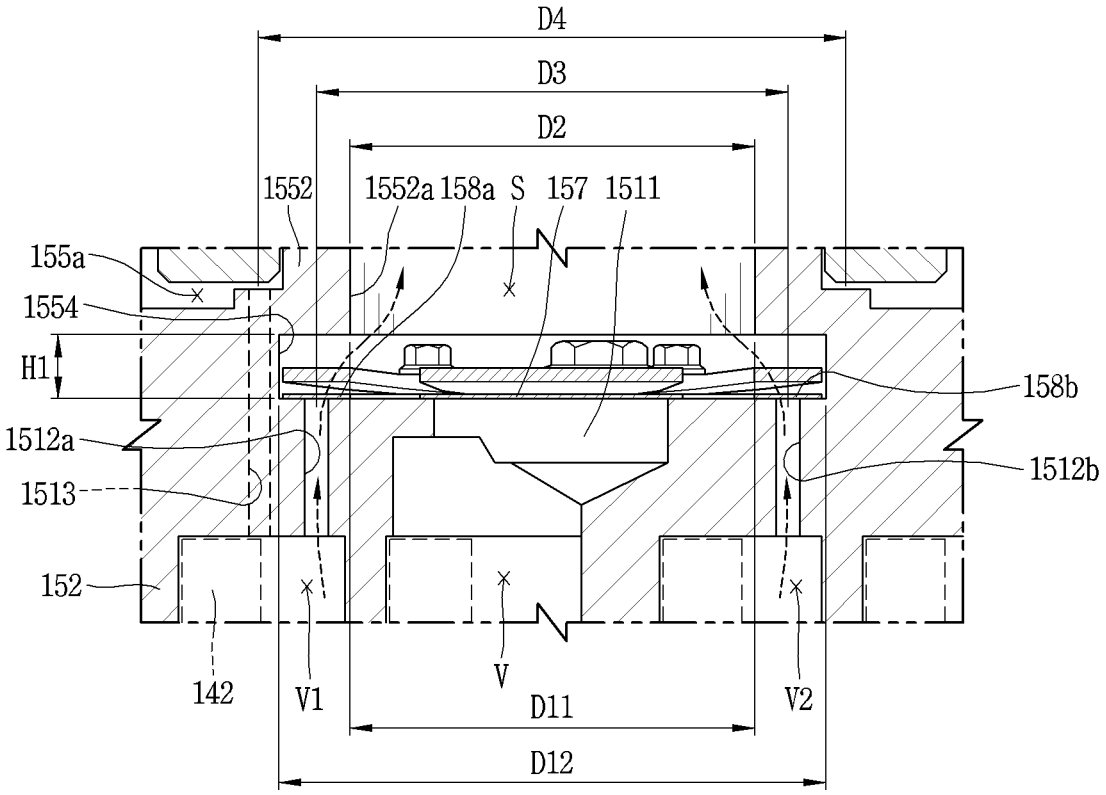
FIG. 5 is a cross-sectional view showing the periphery of a discharge chamber in FIG. 4.

FIG. 1 is a longitudinal cross-sectional view showing the inside of a variable capacity-type scroll compressor according to the present embodiment, FIG. 2 is an exploded perspective view of a back pressure chamber part provided in a non-orbiting scroll in FIG. 1, FIG. 3 is a plan view of FIG. 2, FIG. 4 is a cross-sectional view taken along line "IV-IV" of FIG. 3, and FIG. 5 is a cross-sectional view showing the periphery of a discharge chamber in FIG. 4.

A low-pressure capacity-variable scroll compressor (hereinafter, abbreviated as scroll compressor) according to an implementation may include a driving motor 120 installed in a lower half part of a casing 110 to configure a motor unit, and a main frame 130, an orbiting scroll 140, a non-orbiting scroll 150, and a back pressure chamber part 155 installed above the driving motor 120 to configure a compression unit. The motor unit may be coupled to one end of a rotation shaft 125, and the compression unit may be coupled to another end of the rotation shaft 125. Accordingly, the compression unit may be connected to the motor unit by the rotation shaft 125 to be operated by a rotational force of the motor unit.

Referring to FIG. 1, the casing 110 according to the implementation may include a cylindrical shell 111, an upper cap 112, and a lower cap 113.

The cylindrical shell 111 may have a cylindrical shape with upper and lower ends open, and the drive motor 120 and the main frame 130 may be fitted on an inner circumferential surface of the cylindrical shell 111. A terminal bracket (not illustrated) may be coupled to an upper half part of the cylindrical shell 111. A terminal (not illustrated) for transmitting external power to the drive motor 120 may be coupled through the terminal bracket. In addition, a refrigerant suction pipe 117 to be explained later may be coupled to the upper portion of the cylindrical shell 111, for example, above the driving motor 120.

The upper cap 112 may be coupled to cover the upper opening of the cylindrical shell 111. The lower cap 113 may be coupled to cover the lower opening of the cylindrical shell 111. A rim of a high/low pressure separation plate 115 to be explained later may be inserted between the cylindrical shell 111 and the upper cap 112 to be welded on the cylindrical shell 111 and the upper cap 112. A rim of a support bracket 116 to be described later may be inserted between the cylindrical shell 111 and the lower cap 113 to be welded on the cylindrical shell 111 and the lower cap 113. Accordingly, the inner space of the casing 110 may be sealed.

The rim of the high/low pressure separation plate 115 may be welded on the casing 110 as described above. A central portion of the high/low pressure separation plate 115 may protrude toward the upper cap 112 so as to be disposed above the back pressure chamber part 155 to be described later. A refrigerant suction pipe 117 may communicate with a space below the high/low pressure separation plate 115, and a refrigerant discharge pipe 118 may communicate with a space above the high and low separation plate 115. Accordingly, a low-pressure part 110*a* constituting a suction space may be provided below the high/low pressure separation plate 115, and a high-pressure part 110*b* constituting a discharge space may be provided above the high/low pressure separation plate 115.

In addition, a through hole 115*a* may be provided through a center of the high/low pressure separation plate 115, and a sealing plate 1151 to which a floating plate 1553 to be described later is detachably coupled may be inserted into the through hole 115*a*. Accordingly, the low-pressure part 110*a* and the high-pressure part 110*b* may be blocked from or communicate with each other by the floating plate 1553 and the sealing plate 1151.

The sealing plate 1151 may be provided in an annular shape. For example, the high/low pressure communication hole 1151*a* may be provided through a center of the sealing plate 1151 so that the low-pressure part 110*a* and the high-pressure part 110*b* communicate with each other. The floating plate 1553 may be attachable and detachable along a circumference of the high/low pressure communication hole 1151*a*. Accordingly, the floating plate 1553 may be attached to or detached from the circumference of the high/low pressure communication hole 1151*a* of the sealing plate 1151 while moving up and down by back pressure in an axial direction. During this process, the low-pressure part 110*a* and the high-pressure part 110*b* may be sealed from each other or communicate with each other.

In addition, the lower cap 113 may define an oil storage space 110*c* together with the lower portion of the cylindrical shell 111 constituting the low-pressure part 110*a*. In other words, the oil storage space 110*c* may be defined in the lower portion of the low-pressure part 110*a*. The oil storage space 110*c* may define a part of the low-pressure part 110*a*.

Hereinafter, the drive motor will be described.

The driving motor 120 according to the implementation may be disposed in the lower portion of the low-pressure part 110*a* and include a stator 121 and a rotor 122. The stator 121 may be shrink-fitted onto an inner wall surface of the cylindrical shell 111. The rotor 122 may be rotatably disposed inside the stator 121.

Referring to FIG. 1, the stator 121 according to the implementation may include a stator core 1211 and a stator coil 1212.

The stator core 1211 may be provided in a cylindrical shape and may be shrink-fitted onto the inner circumferential surface of the cylindrical shell 111. The stator coil 1212 may be wound around the stator core 1211 and may be electrically connected to an external power source through a terminal (not illustrated) that is coupled through the casing 110.

The rotor 122 may include a rotor core 1221 and permanent magnets 1222.

The rotor core 1221 may be provided in a cylindrical shape, and may be rotatably inserted into the stator core 1211 with a preset gap therebetween. The permanent magnets 1222 may be embedded in the rotor core 1221 at preset intervals along a circumferential direction.

The rotating shaft 125 may be coupled to the center of the rotor 122. An upper end portion of the rotating shaft 125 may be rotatably inserted into the main frame 130 to be explained later, to be supported in the radial direction. A lower end portion of the rotating shaft 125 may be rotatably inserted into the support bracket 116 to be supported in the radial and axial directions. The main frame 130 may be provided with a main bearing (no reference numeral) for supporting the upper end portion of the rotating shaft 125. The main frame 130 may be provided with a sub bearing (no reference numeral) for supporting the lower end portion of the rotating shaft 125.

An eccentric portion 125*a* eccentrically coupled to the orbiting scroll 140 to be described later may be provided on an upper end of the rotation shaft 125. An oil pickup 126 for sucking up oil stored in the lower portion of the casing 110 may be disposed in a lower end of the rotation shaft 125. An oil passage 125*b* may be provided through the rotation shaft 125 in the axial direction.

Next, the main frame will be described.

The main frame 130 according to this implementation may be disposed above the driving motor 120 and may be shrink-fitted or welded to an inner wall surface of the cylindrical shell 111.

Referring to FIG. 1, the main frame 130 may include a main flange portion 131, a main bearing portion 132, an orbiting space portion 133, a scroll support portion 134, an Oldham ring support portion 135, and a frame fixing portion 136.

The main flange portion 131 may be provided in an annular shape and accommodated in the low-pressure part 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 to be described later may protrude from an outer circumferential surface of the main flange portion 131 in the radial direction. The outer circumferential surface of the frame fixing portion 136 may be fixed in close contact with the inner circumferential surface of the casing 110. Accordingly, the frame 130 can be fixedly coupled to the casing 110.

The main bearing portion 132 may protrude downward from a lower surface of a central part of the main flange portion 131 toward the driving motor 120. A bearing hole 132*a* provided in a cylindrical shape may penetrate through the main bearing portion 132 in the axial direction. A main bearing (no reference numeral) configured as a bush bearing may be fixedly fitted to an inner circumferential surface of the bearing hole 132*a*.

The orbiting space portion 133 may recessed from the center part of the main flange portion 131 toward the main bearing portion 132 to a predetermined depth and outer diameter. The outer diameter of the orbiting space portion 133 may be larger than an outer diameter of a rotation shaft coupling portion 143 that is disposed on the orbiting scroll 140 to be described later. Accordingly, the rotation shaft coupling portion 143 may be pivotally accommodated in the orbiting space portion 133.

The scroll support portion 134 may be provided in an annular shape on an upper surface of the main flange portion 131 along a circumference of the orbiting space portion 133.

Accordingly, the scroll support portion 134 may support the lower surface of an orbiting end plate 141 to be described later in the axial direction.

The Oldham ring support portion 135 may be provided in an annular shape on an upper surface of the main flange portion 131 along an outer circumferential surface of the scroll support portion 134. Accordingly, an Oldham ring 170 may be inserted into the Oldham ring supporting portion 135 to be pivotable.

The frame fixing portion 136 may be provided to extend radially from an outer periphery of the Oldham ring supporting portion 135. The frame fixing portion 136 may extend in an annular shape or may extend to form a plurality of protrusions spaced apart from one another by preset intervals.

On the other hand, the frame fixing portions 136 may be provided at preset intervals along the circumferential direction, and a kind of suction guide space (no reference numeral) may be defined between the frame fixing portions 136. Accordingly, a refrigerant suctioned into the low-pressure part 110*a* may be guided to a suction guide 190 to be described later through the suction guide space between the adjacent frame fixing portions 136. Accordingly, refrigerant suctioned into the low-pressure part 110*a* through the refrigerant suction pipe 117 may be separated while passing through the suction guide space, so that some move to the compression chamber V and the other moves toward the drive motor 120.

Hereinafter, the orbiting scroll will be described.

The orbiting scroll 140 according to the implementation may be disposed on an upper surface of the main frame 130. Accordingly, it may be advantageous in terms of motor efficiency that the orbiting scroll 140 is provided of a hard material such as aluminum. In addition, as it is provided of a different material from the main frame 130 that is cast iron, it may be advantageous in terms of wear resistance.

Referring to FIG. 1, the orbiting scroll 140 according to the implementation may include an orbiting end plate 141, an orbiting wrap 142, and a rotating shaft coupling portion 143.

The orbiting end plate 141 may be provided approximately in a disk shape. An outer diameter of the orbiting end plate 141 may be mounted on the scroll support portion 134 of the main frame 130 to be supported in the axial direction.

The orbiting wrap 142 may be provided in a spiral shape by protruding from an upper surface of the orbiting end plate 141 facing the non-orbiting scroll 150 to a preset height. The orbiting wrap 142 may be provided to correspond to the non-orbiting wrap 152 to perform an orbiting motion by being engaged with a non-orbiting wrap 152 of the non-orbiting scroll 150 to be described later. The orbiting wrap 142 may define a compression chamber V together with the non-orbiting wrap 152.

Here, the compression chamber V may include a first compression chamber V1 and a second compression chamber V2 based on the non-orbiting wrap 152 to be described later. The first compression chamber V1 may be provided at an outer surface of the non-orbiting wrap 152, and the second compression chamber V2 may be provided at an inner surface of the non-orbiting wrap 152. Each of the first compression chamber V1 and the second compression chamber V2 may include a suction pressure chamber (not illustrated), an intermediate pressure chamber (not illustrated), and a discharge pressure chamber (not illustrated) that are continuously provided.

The rotating shaft coupling portion 143 may protrude from a lower surface of the orbiting end plate 141 toward the main frame 130. The rotation shaft coupling portion 143 may be provided in a cylindrical shape. An eccentric portion bearing (no reference numeral) may be fitted onto the inner circumferential surface of the rotating shaft coupling portion 143.

A length of the rotating shaft coupling portion 143 may be shorter than a depth of the orbiting space portion 133. An outer diameter of the rotating shaft coupling portion 143 may be smaller than an inner diameter of the orbiting space portion 133 by at least twice the orbiting radius. Accordingly, the rotating shaft coupling portion 143 may perform the orbiting motion while being accommodated in the orbiting space portion 133.

Meanwhile, the Oldham ring 170 may be provided between the main frame 130 and the orbiting scroll 140 to restrict a rotational motion of the orbiting scroll 140. As described above, the Oldham ring 170 may be slidably coupled to the main frame 130 and the orbiting scroll 140, respectively, or slidably coupled to the orbiting scroll 140 and the non-orbiting scroll 150, respectively.

Hereinafter, the non-orbiting scroll will be described.

The non-orbiting scroll 150 according to the implementation may be disposed on an upper portion of the main frame 130 with the orbiting scroll 140 interposed therebetween, and form a compression chamber V together with the orbiting scroll 140. Accordingly, it may be advantageous in terms of wear resistance that the non-orbiting scroll 150 is provided of cast iron that is different from the material forming the orbiting scroll 140.

The non-orbiting scroll 150 may be fixedly coupled to the main frame 130 or may be coupled to the main frame 130 to be movable up and down. The implementation illustrates an example in which the non-orbiting scroll 150 is coupled to the main frame 130 to be movable relative to the main frame 130 in the axial direction.

Referring to FIGS. 1 to 5, the non-orbiting scroll 150 according to the implementation may include a non-orbiting end plate 151, a non-orbiting wrap 152, a non-orbiting side wall portion 153, a guide protrusion 154, and a back pressure chamber part 155.

The non-orbiting end plate 151 may be provided in a disk shape and disposed in a horizontal direction in the low-pressure part 110*a* of the casing 110. A discharge port 1511, a bypass hole 1512, and a back pressure hole 1513 may be provided through the central portion of the non-orbiting end plate 151 in the axial direction.

The discharge port 1511 may be located at a position where a discharge pressure chamber (no reference numeral given) of the first compression chamber V1 and a discharge pressure chamber (no reference numeral given) of the second compression chamber V2 communicate with each other. Although not shown in the drawings, a discharge guide groove may be further provided on an end of the discharge port 1511.

The bypass hole 1512 may include a first bypass hole 1512*a* communicating with the first compression chamber V1 and a second bypass hole 1512*b* communicating with the second compression chamber V2. The first bypass hole 1512*a* and the second bypass hole 1512*b* may be provided in the circumferential direction at both sides of the discharge port 1511 with the discharge port 1511 therebetween.

The first bypass hole 1512*a* and the second bypass hole 1512*b* may be provided at positions axially overlapping a back pressure chamber inner wall 1552 to be described later in the radial direction, or may be provided between the discharge port 1511 and a back pressure inner wall 1552.

The first bypass hole 1512*a* and the second bypass hole 1512*b* will be described later together with a communicating recess portion.

The back pressure hole 1513 is provided to penetrate through the non-orbiting head end plate 151 in the axial direction and communicates with the compression chamber V having an intermediate pressure between a suction pressure and a discharge pressure. Only one back pressure hole 1513 may be provided to communicate with either of the first compression chamber V1 and the second compression chamber V2, or a plurality of back pressure holes 1513 may be provided to communicate with both compression chambers V1 and V2, respectively. The back pressure hole 1513 will also be described later along with the bypass hole 1512.

The non-orbiting wrap 152 is provided to extend in the axial direction from a lower surface of the non-orbiting end plate 151. The non-orbiting wrap 152 may be spirally provided inside the non-orbiting side wall portion 153, and may be provided to correspond to the orbiting wrap 142 to be engaged with the orbiting wrap 142. The description of the non-orbiting wrap 152 is replaced with the description of the orbiting wrap 142.

The non-orbiting side wall portion 153 is provided to extend in the axial direction from the edge of the lower surface of the non-orbiting end plate 151 in an annular shape so as to surround the non-orbiting wrap 152. A suction port 1531 penetrating in the radial direction is provided on one side of the outer circumferential surface of the non-orbiting side wall portion 153.

One end of the suction port 1531 communicates with the low-pressure part 110*a* of the casing 110, and the other end communicates with the suction pressure chambers of both compression chambers V1 and V2. Accordingly, the refrigerant is sucked into the low-pressure part 110*a* of the casing 110 constituting the low-pressure part through the refrigerant suction pipe 117, and this refrigerant is introduced into the suction pressure chamber of the first compression chamber V1 and the second compression chamber V2 through the suction port 1531.

The guide protrusion 154 extends radially from the lower outer circumferential surface of the non-orbiting side wall portion 153 so as to be mounted on the upper surface of the frame fixed portion 136 and fixed in the axial direction. The guide protrusion 154 may be provided as a single guide protrusion having an annular shape, or a plurality of guide protrusions 154 may be provided at preset intervals along the circumferential direction. This embodiment shows an example in which a plurality of guide protrusions 144 are provided at preset intervals along the circumferential direction.

The back pressure chamber part 155 according to the present embodiment is provided on an upper surface of the non-orbiting scroll 150, and at least a portion thereof extends as a single body from an upper surface of the non-orbiting scroll 150, that is, the non-orbiting end plate 151, to be provided.

Referring to FIGS. 1 to 5, the back pressure chamber part 155 according to the present exemplary embodiment may include a back pressure chamber outer wall 1551, a back pressure chamber inner wall 1552, and a floating plate 1553. The back pressure chamber outer wall 1551 and the back pressure chamber inner wall 1552 extend as a single body from the non-orbiting end plate 151. The floating plate 1553 is slidably inserted between the back pressure chamber outer wall 1551 and the back pressure chamber inner wall 1552. Accordingly, the back pressure chamber outer wall 1551 and the back pressure chamber inner wall 1552 that form part of the back pressure chamber part 155 are provided as a single body on the non-orbiting scroll 150, so that the back pressure chamber part 155 may be easily provided.

The back pressure chamber outer wall 1551 extends upwardly from an upper surface edge of the non-orbiting end plate 151 toward the high/low pressure separation plate 115. The back pressure chamber inner wall 1552 extends upwardly from the central portion of the upper surface of the non-orbiting end plate 151 toward the high/low pressure separation plate 115. As the back pressure chamber outer wall 1551 and the back pressure chamber inner wall 1552 are integrally provided to extend from the non-orbiting end plate 151, the back pressure chamber outer wall 1551 and the back pressure chamber inner wall 1552 may be provided of cast iron like the non-orbiting end plate 151.

The back pressure chamber outer wall 1551 and the back pressure chamber inner wall 1552 are provided to have substantially the same height (axial length) and thickness. However, the height of the back pressure chamber outer wall 1551 and the back pressure chamber inner wall 1552 may be provided in various ways depending on the shapes of the high/low pressure separation plate 115 and the floating plate 1553. For example, when the high/low pressure separation plate 115 is provided in a truncated-conical shape and in the case of so-called inner insertion in which the outer circumferential surface of the floating plate 1553 is inserted into a back pressure chamber 155*a*, the back pressure chamber outer wall 1551 and the back pressure chamber inner wall 1552 may be provided at approximately the same height.

However, when the high/low pressure separation plate 115 is provided in a truncated-conical shape and in the case of a so-called outer insertion in which the outer circumferential surface of the floating plate 1553 is inserted outside the back pressure chamber 155*a*, the height of the back pressure chamber outer wall 1551 may be provided to be lower than the height of the back pressure inner wall 1552.

A thickness of the back pressure chamber outer wall 1551 may be substantially the same as a thickness of the back pressure chamber inner wall 1552. However, the thickness of the back pressure chamber outer wall 1551 and the back pressure chamber inner wall 1552 may be adjusted depending on whether a sealing member, which will be described later, is installed.

For example, when each the first sealing member 1555*a* and the second sealing member 1555*b*, which will be described later, is installed on the floating plate 1553, the thickness of the back pressure chamber outer wall 1551 and the thickness of the back pressure chamber inner wall 1552 are provided to be the same. Meanwhile, when the first sealing member 1555 an or the second sealing member 1555*b*, which will be described later, are installed on the back pressure chamber outer wall 1551 or the back pressure chamber inner wall 1552, the thicknesses of the walls on which the sealing members 1555*a* and 1555*b* are installed are greater than thicknesses of the 1551 and 1552 are provided to be thicker than the thicknesses of the walls 1551 and 1552 on which the sealing members 1555*a* and 1555*b* are not installed.

Meanwhile, a communicating recess portion 1554 depressed by a preset depth in the radial direction to communicate with the bypass hole 1512 is provided on the inner circumferential surface of the back pressure chamber inner wall 1552. Accordingly, even if the bypass hole 1512 is covered by the inner wall 1552, the bypass hole 1512 may communicate with the discharge chamber S through the communicating recess portion 1554. The communicating recess portion 1554 will be described again later.

The floating plate 1553 according to this embodiment is provided above the back pressure chamber outer wall 1551 and the back pressure chamber inner wall 1552 of the non-orbiting scroll 150 to cover the upper surface of the back pressure chamber 155*a* but are slidably coupled to main surfaces of the back pressure chamber outer wall 1551 and the back pressure chamber inner wall 1552. Accordingly, the back pressure chamber 155*a* defined by the upper surface of the non-orbiting end plate 151, the inner circumferential surface of the back pressure chamber outer wall 1551, the outer circumferential surface of the back pressure chamber inner wall 1552, and the lower surface of the floating plate 1553 is provided, and this back pressure chamber is sealed by these surfaces. In addition, the sealed back pressure chamber 155*a* may be separated from the low-pressure part 110*a* and/or the high-pressure part 110*b* of the casing 110.

The floating plate 1553 be advantageously provided of a material as hard as possible so that it may be raised or lowered according to a change in the internal pressure, i.e., back pressure, of the back pressure chamber 155*a* when the compressor is stopped/operated. For example, the floating plate 1553 may be provided of an engineer plastic material. However, since the floating plate 1553 rises in the axial direction during an operation of the compressor and collides with the sealing plate 1151 of the high/low pressure separation plate 115, it may be advantageous for the floating plate 1553 to be provided of a metal material as hard as possible in terms of reliability. For example, the floating plate 1553 may be provided by surface-treating an aluminum material on a synthetic resin.

Specifically, the floating plate 1553 includes an upper cover portion 1553*a*, an outer cover portion 1553*b*, and an inner cover portion 1553*c*. The upper cover portion 1553*a*, the outer cover portion 1553*b*, and the inner cover portion 1553*c* are provided as a single body.

The upper cover portion 1553*a* is provided in an annular shape and may be provided to be substantially equal to or slightly smaller than an interval between the back pressure chamber outer wall 1551 and the back pressure chamber inner wall 1552 of the non-orbiting scroll 150. Accordingly, the upper cover portion 1553*a* may cover the back pressure chamber outer wall 1551 and the back pressure chamber inner wall 1552 constituting the back pressure chamber 155*a*.

A sealing protrusion 1553*d* is provided on an upper surface of the inner circumferential side of the upper cover portion 1553*a*. The sealing protrusion 1553*d* is in close contact with the sealing plate 1151 of the high/low pressure separation plate 115 when the floating plate 1553 rises, to separate the low-pressure part 110*a* and the high-pressure part 110*b*. The sealing protrusion 1553*d* is provided in an annular shape, and may be surface-hardened to prevent wear.

The outer cover portion 1553*b* is provided in an annular shape and extends from the outer periphery of the upper cover portion 1553*a* toward the non-orbiting scroll 150 in the axial direction. The outer cover portion 1553*b* may be slidably internally inserted into the inner circumferential surface of the back pressure chamber outer wall 1551 or may be slidably externally inserted into the outer circumferential surface of the back pressure chamber outer wall 1551.

For example, when the outer cover portion 1553*b* is internally inserted into the back pressure chamber outer wall 1551, an outer diameter of the floating plate 1553 is reduced, so that a weight of the floating plate 1553 may be reduced. Accordingly, during an operation of the compressor, the floating plate 1553 rises rapidly to separate the low-pressure part 110*a* and the high-pressure part 110*b*. Meanwhile, when the outer cover portion 1553*b* is externally inserted into the back pressure chamber outer wall 1551, a back pressure area of the back pressure chamber 155*a* is enlarged, thereby tightly sealing the low-pressure part 110*a* and the high-pressure part 110*b*. In this embodiment, an example in which the outer cover portion 1553*b* is internally inserted into the back pressure chamber outer wall 1551 will be mainly described.

An outer cover member (hereinafter, referred to as a first sealing member) 1555*a* is inserted between the outer circumferential surface of the outer cover portion 1553*b* and the inner circumferential surface of the back pressure chamber outer wall 1551. For example, an outer sealing recess (hereinafter, referred to as a first sealing recess) 1551*a* is provided in an annular shape on the inner circumferential surface of the back pressure chamber outer wall 1551, and a first sealing member 1555*a* is inserted into the first sealing recess 1551*a* to be coupled. The first sealing member 1555*a* may be provided of a sealing member having elasticity such as an O-ring.

However, the first sealing member 1555*a* may be provided on the outer circumferential surface of the outer cover portion 1515 facing the inner circumferential surface of the back pressure chamber outer wall 1551. In this case, it may be advantageous in terms of machining degree and thus sealing reliability to form a first sealing recess (not shown) on the outer circumferential surface of the outer cover portion 1553*b* of the floating plate 1553 having a relatively higher machining roughness than the back pressure chamber outer wall 1551 of the non-orbiting scroll 150 to couple the sealing member 1555*a*.

The inner cover portion 1553*c* is provided substantially similar to the outer cover portion 1553*b*. For example, the inner cover portion 1553*c* is provided in an annular shape and extends from the inner periphery of the upper cover portion 1553*a* toward the non-orbiting scroll 150 in the axial direction.

The inner cover portion 1553*c* may be slidably inserted (externally inserted) into the outer circumferential surface of the back pressure chamber inner wall 1552 or may be slidably inserted (internally inserted) into an inner circumferential surface 1552*a* of the back pressure chamber inner wall 1552. When the inner cover portion 1553*c* is externally inserted into the back pressure chamber inner wall 1552, the inner circumferential surface 1552*a* of the back pressure chamber inner wall 1552 forms a discharge passage (no reference numeral given), thereby increasing a cross-sectional area of the discharge passage (no reference numeral given). Through this, flow resistance of a refrigerant discharged from the compression chamber V to the discharge chamber S is reduced, so that the refrigerant may be rapidly discharged and the compression efficiency may be improved.

Meanwhile, when the inner cover portion 1553*c* is internally inserted into the back pressure chamber inner wall 1552, the internal volume (back pressure area) of the back pressure chamber 155*a* may be enlarged. Accordingly, it is possible to sufficiently secure the back pressure in the back pressure chamber 155*a* to expand an operation range of the compressor. In the present embodiment, an example in which the inner cover portion 1553*c* is externally inserted will be mainly described.

An inner cover member (hereinafter, a second sealing member) 1555*b* is inserted between the inner circumferential surface of the inner cover portion 1553*c* and the outer circumferential surface of the back pressure chamber inner wall 1552 facing the inner circumferential surface of the inner cover portion 1553*c*. For example, an inner sealing recess (hereinafter, referred to as a second sealing recess) 1553*c*1 is provided in an annular shape on the inner circumferential surface of the inner cover portion 1553*c*, and a second sealing member 1555*b* is insertedly coupled to the second sealing recess 1553*c*1. Like the first sealing member 1555*a*, the second sealing member 1555*b* may be provided of a sealing member having elasticity such as an O-ring.

The second sealing member 1555*b* may be provided on the outer circumferential surface of the back pressure chamber inner wall 1552 facing the inner circumferential surface of the inner cover portion 1553*c*. However, like the first sealing recess 1551*a* described above, it may be advantageous in terms of machining degree and thus sealing reliability for the second sealing recess 1553*c*1 to be also provided on the inner cover portion 1553*c* of the floating plate 1553 to increase the machining roughness.

In the drawings, reference numeral 157 denotes a discharge valve, and 158*a* and 158*b* denote bypass valves.

The scroll compressor according to the present embodiment as described above operates as follows.

That is, when the compressor is stopped, the pressure in the intermediate pressure chamber communicating with the back pressure hole 1513 is low, so that the pressure in the back pressure chamber 155*a* is lowered. When the pressure in the back pressure chamber 155*a* is lowered, the floating plate 1553 is lowered in a direction toward the non-orbiting scroll 150.

Then, the floating plate 1553 is spaced apart from the high/low pressure separation plate 115 and the low-pressure part 110*a* and the high-pressure part 110*b* communicate with each other, so that the refrigerant of the high-pressure part 110*b* leaks to the low-pressure part 110*a*, thereby achieving a pressure equilibrium both in the high-pressure part 110*b* and the low-pressure part 110*a*. Then, the discharge valve 157 is closed to block the discharge port 1511. Accordingly, a backflow of the refrigerant of the high-pressure part 110*a* into the compression chamber V is blocked.

Meanwhile, during the operation of the compressor, the orbiting scroll 140 coupled to the rotation shaft 125 makes an orbiting motion with respect to the non-orbiting scroll 150, and the refrigerant is sucked into the pair of compression chambers V provided between the orbiting wrap 142 and the non-orbiting wrap 152 and compressed.

This refrigerant is gradually compressed while moving from the outside to the inside of the compression chamber V and then discharged to the discharge chamber S constituting the high-pressure part 110*b* through the discharge port 1511, and discharged toward a condenser of a refrigeration cycle through the refrigerant discharge pipe 118.

At this time, a portion of the refrigerant moving toward the discharge port 1511 while being compressed in the compression chamber V moves to the back pressure chamber 155*a* through the back pressure hole 1513 before reaching the discharge port 1511. Accordingly, the back pressure chamber 155*a* forms an intermediate pressure lower than the discharge pressure.

Then, as the floating plate 1553 is pushed up by the pressure of the back pressure chamber 155*a* and rises, the sealing protrusion 1553*d* of the floating plate 1553 comes into close contact with the high/low pressure separation plate (more precisely, the sealing plate) 115. Then, the high-pressure part 110*b* of the casing 110 is separated from the low-pressure part 110*a* and the refrigerant discharged from the respective compression chambers V1 and V2 to the high-pressure part 110*b* may be prevented from flowing back into the low-pressure part 110*a*.

In addition, the non-orbiting scroll 150 is pressed by the pressure of the back pressure chamber 155*a* and descends to almost come into close contact with the orbiting scroll 140. Accordingly, the refrigerant compressed in the compression chamber V is prevented from leaking from the high pressure side forming the discharge pressure chamber to the low pressure side forming the intermediate pressure chamber.

Meanwhile, the refrigerant in the compression chamber is compressed to a set pressure while moving from the intermediate pressure chamber constituting each of the compression chambers V1 and V2 toward the discharge pressure chamber, but the pressure of the refrigerant may be increased above a preset pressure depending on other conditions generated during the operation of the compressor. Then, a portion of the refrigerant moving from the intermediate pressure chamber to the discharge pressure chamber is bypassed in advance toward the discharge chamber S forming the high-pressure part 110*b* in each of the compression chambers V1 and V2 through the first bypass hole 1512*a* and the second bypass hole 1512*b* before reaching the discharge pressure chamber. Through this, it is possible to suppress overcompression of the refrigerant above the set pressure in the compression chambers V1 and V2, thereby increasing compressor efficiency and ensuring stability.

However, when the bypass hole 1512 is provided before the discharge port 1511 as in the present embodiment, it may not be easy to form the back pressure chamber 155*a*. That is, the first bypass hole 1512*a* and the second bypass hole 1512*b* are provided at a position having a higher intermediate pressure than the back pressure hole 1513, that is, closer to the discharge port 1511 in axial projection. However, typically, the first bypass hole 1512*a* and the second bypass hole 1512*b* are located not far from the back pressure hole 1513, that is, radially close to the back pressure hole 1513.

However, since the back pressure hole 1513 should be located inside the back pressure chamber 155*a*, the back pressure hole 1513 is located outside the back pressure chamber inner wall 1552 forming the inner wall surface of the back pressure chamber 155*a*. Accordingly, considering the thickness of the back pressure chamber inner wall 1552, the first bypass hole 1512*a* and the second bypass hole 1512*b* are located at a position overlapping the back pressure inner wall 1552 in the axial direction, that is, on an outer side than the inner circumferential surface 1552*a* of the back pressure inner wall 1552. For this reason, if the back pressure chamber inner wall 1552 constituting the back pressure chamber part 155 is provided as a single body from the non-orbiting end plate 151, the upper ends of the first bypass hole 1512*a* and the second bypass hole 1512*b* are blocked by the back pressure chamber inner wall 1552 and cannot communicate with the discharge chamber S. This may make it very difficult to form the bypass hole 1512. This may become more difficult considering the bypass valves 158*a* and 158*b* for opening and closing the respective bypass holes 1512*a* and 1512*b*.

Accordingly, in the present embodiment, a communicating recess portion connecting the discharge chamber and the bypass hole may be provided in the back pressure chamber inner wall of the back pressure chamber part constituting the inner circumferential surface of the discharge chamber. Through this, the bypass hole and the bypass valve may be easily provided, while the back pressure chamber part is provided as a single body in the non-orbiting scroll.

Referring back to FIGS. 3 to 5, in the non-orbiting scroll 150 according to the present embodiment, the discharge port 1511 described above is provided approximately at the center of the non-orbiting end plate 151 forming the center O of the back pressure inner wall 1552 (or the center of the discharge port), and the first bypass hole 1512*a* and the second bypass hole 1512*b* described above are provided at a preset interval along the circumferential direction around the discharge port 1511.

As the discharge port 1511 is provided at the center O of the back pressure chamber inner wall 1552 forming an annular shape, the discharge port 1511 is located on an inner side than the inner circumferential surface 1552*a* of the back pressure chamber inner wall 1552 when projected in the axial direction, and the first bypass hole 1512*a* and the second bypass hole 1512*b* are located on an outer side than the inner circumferential surface 1552*a* of the back pressure chamber inner wall 1552 when projected in the axial direction. Accordingly, the back pressure chamber inner wall 1552 does not block the discharge port 1511, but the first bypass hole 1512*a* and the second bypass hole 1512*b* are blocked by the back pressure chamber inner wall 1552.

A communicating recess portion 1554 extending in a radial direction from the discharge chamber S is provided on the inner circumferential surface 1552*a* of the back pressure chamber inner wall 1552, and the communicating recess portion 1554 communicates with the first bypass hole 1512*a* and the second bypass hole 1512*b* extending in the axial direction.

The communicating recess portion 1554 is provided in an annular shape having a preset width in the radial direction. For example, the communicating recess portion 1554 may be provided by inserting a tool such as a T-shaped cutter toward the back pressure chamber inner wall 1552.

An inner diameter D11 of the communicating recess portion 1554 is the same as an inner diameter D2 of the back pressure chamber inner wall 1552, but an outer diameter D12 of the communicating recess portion 1554 may be greater than a diameter D3 of a virtual circle passing through the center of the first bypass hole 1512*a* or the center of the second bypass hole 1512*b* based on the discharge port 1511. However, the outer diameter D12 of the communicating recess portion 1554 may be smaller than a size in which the communicating recess portion 1554 does not overlap the back pressure hole 1513 in the axial direction, for example, a diameter D4 of a virtual circle passing through the back pressure hole 1513 based on the discharge port 1511.

Although not shown in the drawings, the communicating recess portion 1554 may be provided in an arc shape. However, when the communicating recess portion 1554 has an arc shape, the overall area of the communicating recess portion 1554 may be reduced, compared to the annular shape described above, so that flow resistance with respect to the bypassed refrigerant may increase. Accordingly, when the communicating recess portion 1554 is provided in an annular shape, the refrigerant may be more smoothly bypassed.

In addition, when the communicating recess portion 1554 is provided in an arc shape, it may be advantageous in terms of machining for the communicating recess portion 1554 itself to be provided radially from the outer circumferential surface of the non-orbiting end plate 151 toward the discharge chamber S. This will be described in detail later in another embodiment.

An axial height H1 of the communicating recess portion 1554 is preferably provided as narrow as possible in terms of reliability of the back pressure chamber inner wall 1552. However, since the bypass valves 158*a* and 158*b* may be installed in the communicating recess portion 1554, the axial height H1 of the communicating recess portion 1554 may be adjusted according to the type of the bypass valves 158*a* and 158*b*. For example, when the bypass valves 158*a* and 158*b* are cantilevered reed valves, the axial height H1 of the communicating recess portion 1554 may be relatively high to the extent that a retainer may be installed, whereas when the bypass valves 158*a* and 158*b* are plate valves without a retainer, the axial height H1 of the communicating recess portion 1554 may be relatively small (low).

Although not shown in the drawings, the communicating recess portion 1554 may be provided to have a different height even in the radial direction. For example, the communicating recess portion 1554 may be provided in multiple stages or may be chamfered to be inclined. In other words, the communicating recess portion 1554 may be provided to have a wide inner periphery and a narrow outer periphery. Accordingly, a cross-sectional area of the inner periphery side of the communicating recess portion 1554 in contact with the discharge chamber S may increase, so that the refrigerant may be bypassed more quickly.

As described above, when the communicating recess portion 1554 is provided on the inner circumferential surface 1552*a* of the back pressure chamber inner wall 1552 to connect the bypass holes 1512*a* and 1512*b* and the discharge chamber, the following effects are obtained.

That is, in a non-orbiting back pressure method in which the back pressure chamber 155*a* is provided on the rear surface of the non-orbiting scroll 150, bypass holes 1512*a* and 1512*b* may be provided around the discharge port 1511. Accordingly, the refrigerant overcompressed in the compression chamber V may be discharged in advance through the bypass holes 1512*a* and 1512*b*, thereby preventing overcompression and improving the compression efficiency.

In addition, as the bypass valves 158*a* and 158*b* for opening and closing the bypass holes 1512*a* and 1512*b* are provided on an outlet side of the bypass holes 1512*a* and 1512*b*, the refrigerant in the discharge chamber S is rapidly prevented from flowing back into the compression chamber V through the bypass holes 1512*a* and 1512*b* even when the pressure of the discharge chamber S is higher than the pressure of the compression chamber V. Through this, it is possible to suppress an increase in the specific volume of the refrigerant in the compression chamber V, thereby increasing volumetric efficiency.

In addition, while bypass holes 1512*a* and 1512*b* and bypass valves 158*a* and 158*b* penetrating through the back surface of the non-orbiting scroll 150 are provided, the back pressure chamber outer wall 1551 and the back pressure chamber inner wall 1552 forming the back pressure chamber part 155 may be provided to extend from the non-orbiting end plate 151 of the non-orbiting scroll 150 as a single body. Through this, the structure of the back pressure chamber part 155 may be simplified, thereby reducing the manufacturing cost.

Meanwhile, another embodiment of the back pressure chamber is as follows.

That is, in the embodiment described above, the inner circumferential surface of the back pressure chamber inner wall is provided closer to the discharge port than the bypass hole, but in some cases, the inner circumferential surface of the back pressure chamber inner wall may be located farther from the discharge port than the bypass hole.

Figure 6:
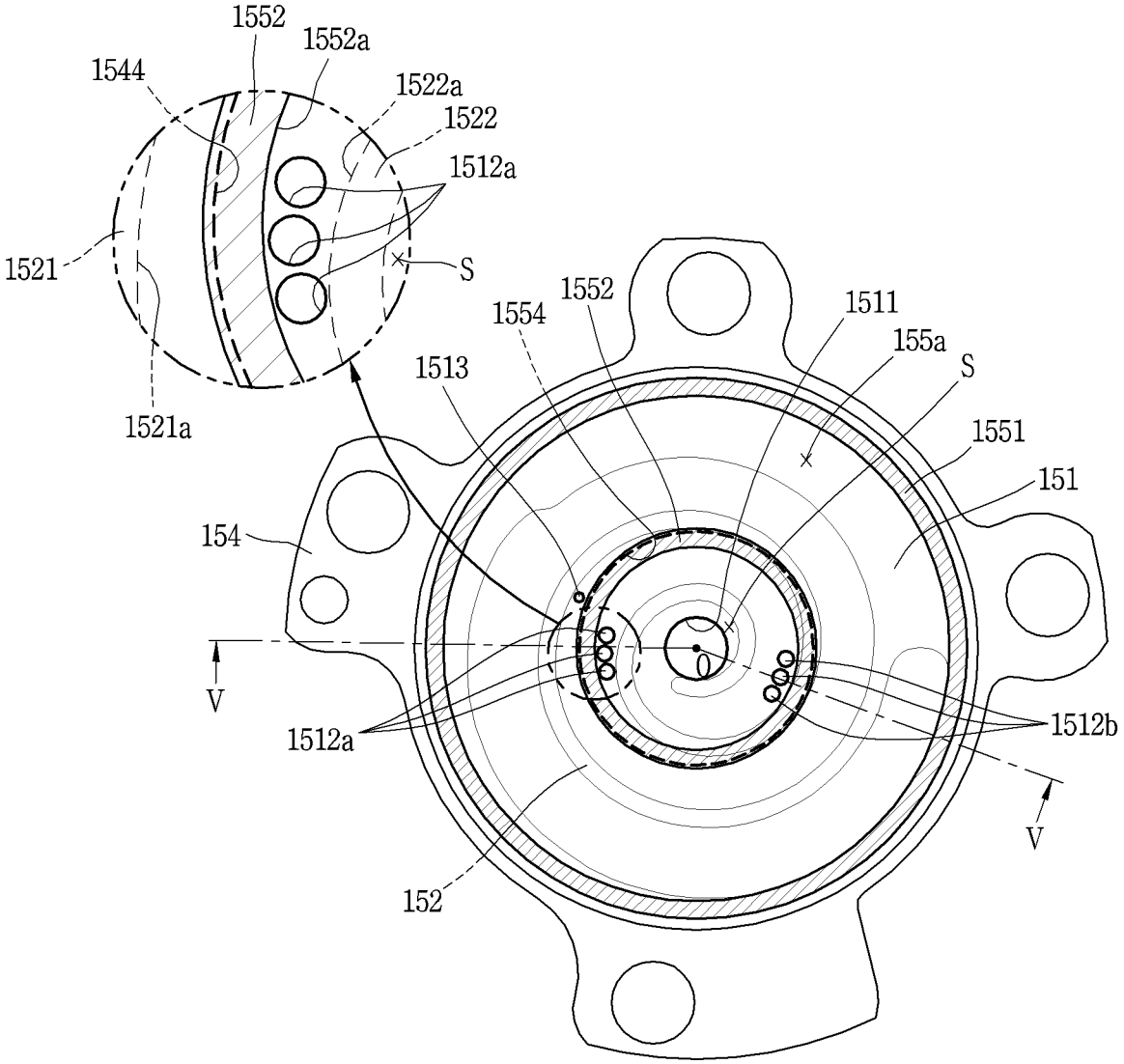
Figure 7:
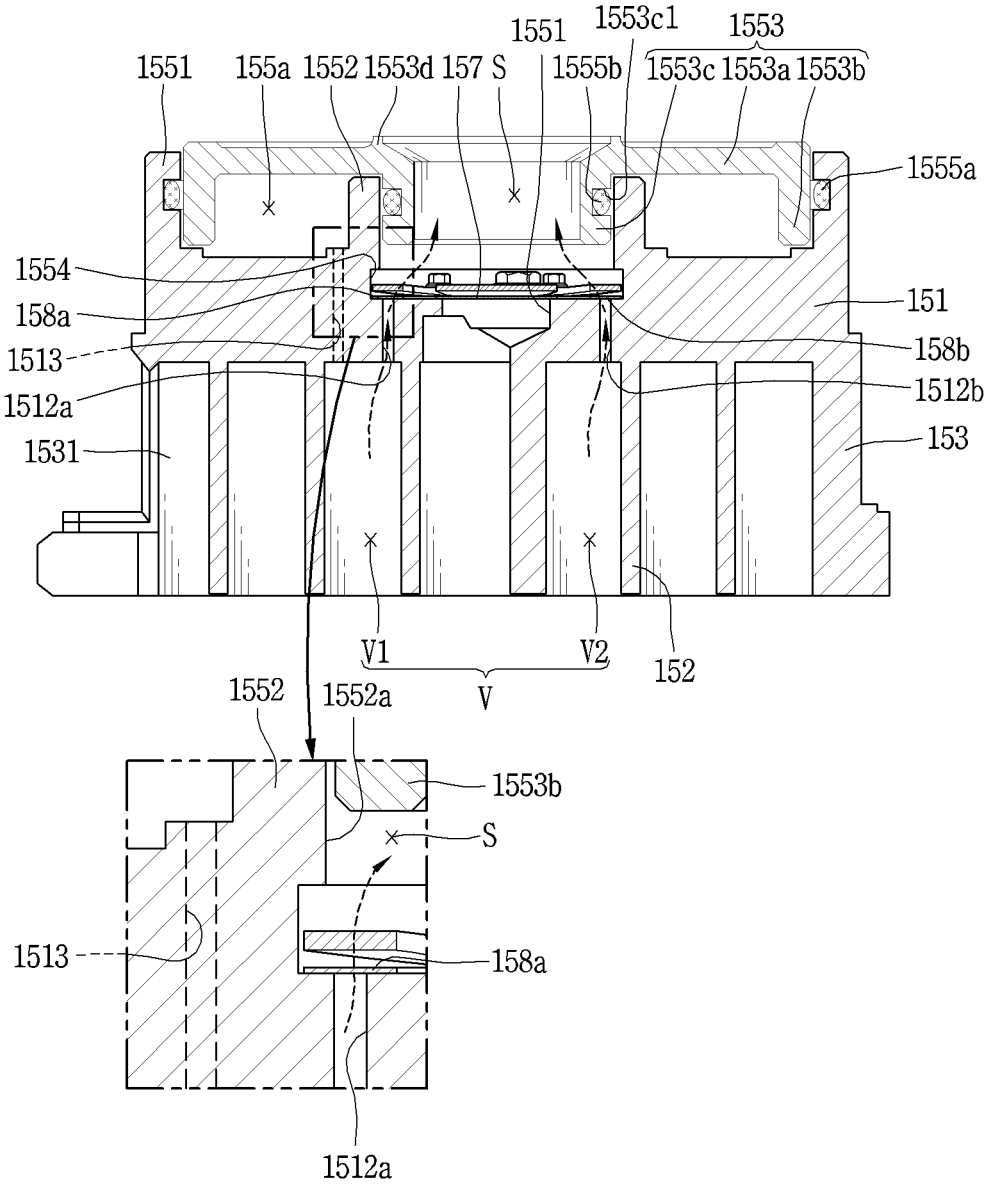
FIG. 7 is a cross-sectional view taken along line "V-V" of FIG. 6.

FIG. 6 is a plan view showing another embodiment of the back pressure chamber in FIG. 2, and FIG. 7 is a cross-sectional view taken along line "V-V" of FIG. 6.

Referring to FIGS. 6 and 7, a basic configuration of the back pressure chamber part 155 including the non-orbiting scroll 150 according to the present embodiment and the effects thereof are similar to those of the embodiment described above. For example, the back pressure chamber outer wall 1551 and the back pressure chamber inner wall 1552 constituting the back pressure chamber part 155 extend from the non-orbiting end plate 151 of the non-orbiting scroll 150 as a single body, and the floating plate 1553 forming the back pressure chamber part 155 is slidably inserted with respect to the back pressure chamber outer wall 1551 and the back pressure chamber inner wall 1552 to form the back pressure chamber 155*a* sealed by the upper surface of the non-orbiting end plate 151, the inner circumferential surface of the back pressure chamber outer wall 1551, and outer circumferential surface of the back pressure inner wall 1552, and the lower surface of the floating plate 1553.

In addition, a discharge port 1511 is provided at the center of the non-orbiting end plate 151, the first bypass hole 1512*a* and the second bypass hole 1512*b* connecting the compression chamber V forming an intermediate pressure chamber and the discharge chamber S are provided around the discharge port 1511, and a back pressure hole 1513 communicating with the first bypass hole 1512*a* and the second bypass hole 1512*b* and connecting the compression chamber V having a pressure lower than that of the intermediate pressure chamber and the back pressure chamber 155*a* is provided on an outer side than the first bypass hole 1512*a* and the second bypass hole 1512*b*.

The discharge port 1511, the first bypass hole 1512*a*, the second bypass hole 1512*b*, and the back pressure hole may be provided at the same location and the same size as in the embodiment described above. Accordingly, when the back pressure chamber inner wall 1552 is provided at the same position as in the embodiment described above, the discharge port 1511 is not blocked by the back pressure chamber inner wall 1552, while the first bypass hole 1512*a* and the second bypass hole 1512*b* may be blocked by the back pressure chamber inner wall 1552. Then, the communicating recess portion 1554 described above should be provided relatively deep in the radial direction.

However, as in the present embodiment, when the back pressure chamber inner wall 1552 is located farther from the discharge port 1511 than in the embodiment described above, at least a portion of the first bypass hole 1512*a* and the second bypass hole 1512*b*, as well as the discharge port 1511, is not blocked by the back pressure chamber inner wall 1552.

For example, in the back pressure chamber inner wall 1552, the inner circumferential surface 1552*a* of the back pressure chamber inner wall 1552 may be provided on an outer side than the first bypass hole 1512*a* and the second bypass hole 1512*b*, that is, to be located farther from the discharge port 1511. Accordingly, at least a portion of the first bypass hole 1512*a* and the second bypass hole 1512*b* is located on an inner side of the back pressure chamber inner wall 1552. Then, even if the communicating recess portion 1554 is provided, the communicating recess portion may be provided to be minimized, so that machining of the communicating recess portion 1554 may be easier compared to the embodiment described above, and the installation of the bypass valves 158*a* and 158*b* may be facilitated. Also, the flow resistance in the communicating recess portion 1554 may be reduced, so that the refrigerant in the compression chamber V may be quickly bypassed to the discharge chamber S through the bypass holes 1512*a* and 1512*b* during overcompression.

In this case, the floating plate 1553 may be assembled by an internal insertion method.

Referring to FIG. 7, the floating plate 1553 according to the present embodiment may include an upper cover portion 1553*a*, an outer cover portion 1553*b*, and an inner cover portion 1553*c*. The upper cover portion 1553*a* and the outer cover portion 1553*b* may be provided to be substantially the same as those in the embodiment described above. However, since the inner cover portion 1553*c* is located inside the back pressure chamber inner wall 1552 beyond the back pressure chamber inner wall 1552, the upper cover portion 1553*a* may be provided to be thinner than in the embodiment described above. Accordingly, in the case of the internal insertion method, even if a radial width of the floating plate 1553 is enlarged compared to the embodiment described above, a weight of the floating plate 1553 may be the same or rather smaller.

In addition, the upper cover portion 1553*a* may be provided to be flat in the radial direction or may be provided to be inclined downward from the center to the edge. For example, when the back pressure chamber inner wall 1552 is lower than the back pressure chamber outer wall 1551 by the thickness of the upper cover portion 1553*a*, the upper cover portion 1553*a* may be provided flat. However, when the back pressure chamber inner wall 1552 is provided to have the same height as the back pressure chamber outer wall 1551, the upper cover portion 1553*a* may be provided to be inclined downward as much as the thickness of the upper cover portion 1553*a*. This embodiment will be described based on an example in which the upper cover portion 1553*a* is flat.

The inner cover portion 1553*c* is provided to be substantially the same as that in the embodiment described above. However, in the inner cover portion 1553*c* according to the present embodiment, a second sealing recess 1553*c*1 may be provided on an outer circumferential surface thereof, and a second sealing member 1555*b* may be inserted into the second sealing recess 1553*c*. Of course, even in this case, the second sealing recess (not shown) may be provided on the inner circumferential surface 1552*a* of the back pressure chamber inner wall 1552.

As described above, when the floating plate 1553 is slidably inserted outside the back pressure chamber 155*a*, that is, into the inner circumferential surface 1552*a* of the back pressure chamber inner wall 1552, an appropriate cross-sectional area of the back pressure chamber 155*a* may be secured even if the back pressure chamber inner wall 1552 is provided to be pushed outward to expose the bypass holes 1512*a* and 1512*b* as described above.

Although not shown in the drawings, when the inner cover portion 1553*c* of the floating plate 1553 is inserted into the inner circumferential side of the back pressure chamber inner wall 1552, a cylindrical valve accommodating portion (not shown) is provided on an inner circumferential surface of the inner cover portion 1553*c*, and a bypass valve (not shown) provided of a piston valve sliding in the axial direction may be inserted into the valve accommodating portion. Accordingly, when the bypass valve provided of a piston valve is applied, the valve accommodating portion accommodating the bypass valve may not be provided in the non-orbiting end plate 151 of the non-orbiting scroll 150. Through this, while applying the piston valve as a bypass valve, the communicating recess portion 1554 described above may be machined and provided.

Meanwhile, another embodiment of the back pressure chamber including the bypass valve is as follows.

That is, in the embodiment described above, the bypass valve is installed outside the bypass hole, but in some cases, the bypass valve may be installed inside the bypass hole.

Figure 8:
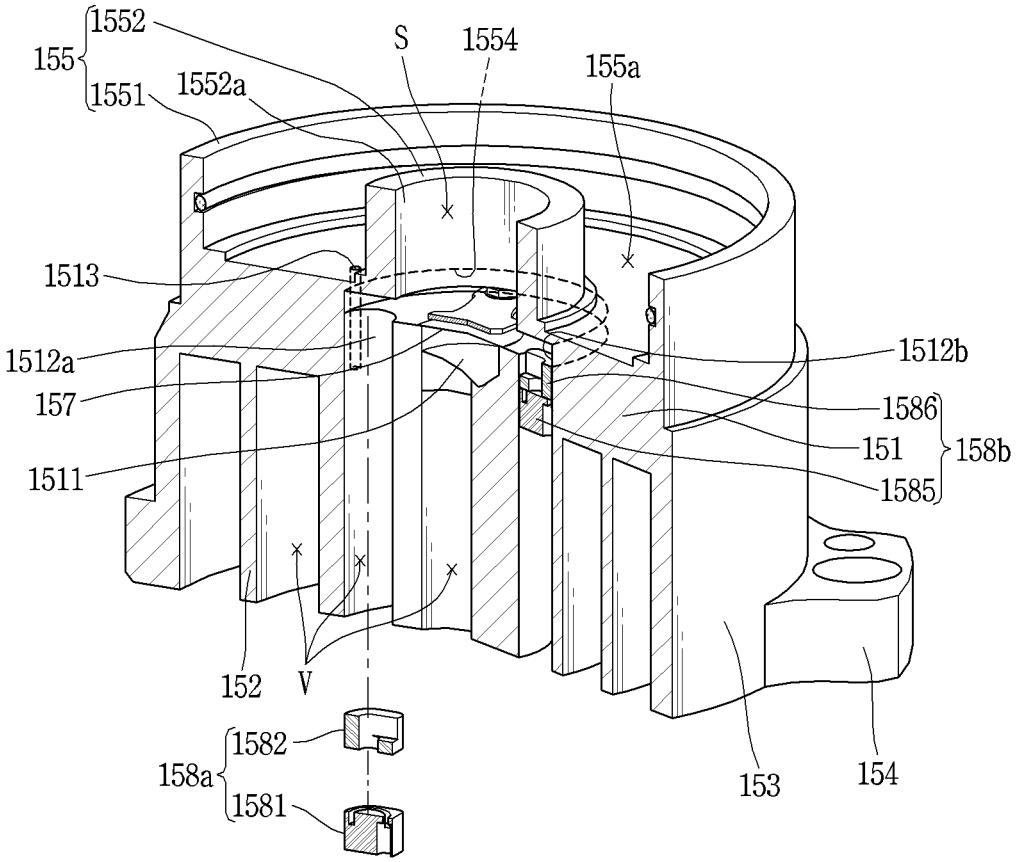
FIG. 8 is an exploded perspective view of another embodiment of a back pressure chamber part in FIG. 1.
Figure 9:
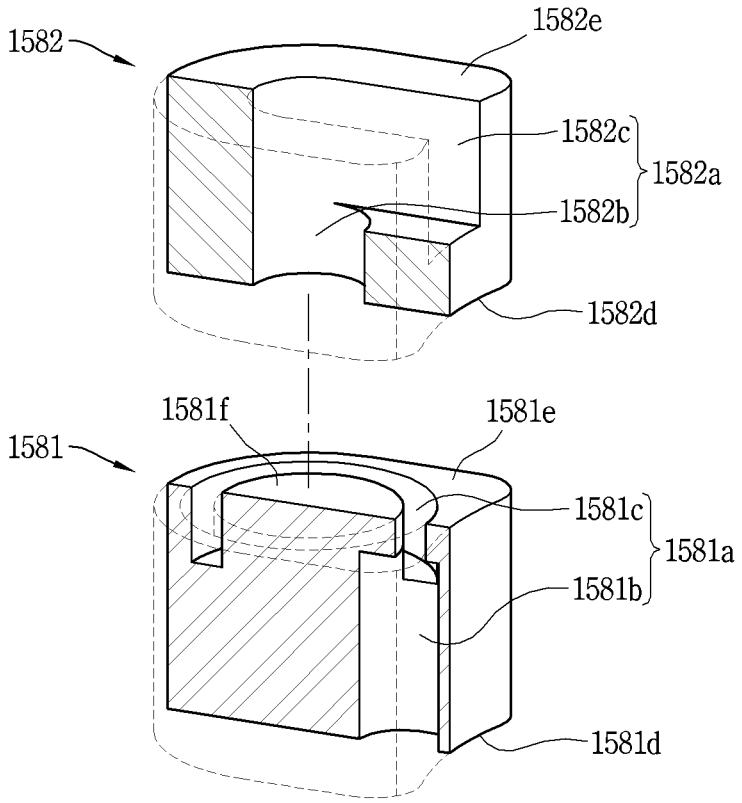
FIG. 9 is an exploded perspective view of a bypass valve shown in FIG. 8.
Figure 10:
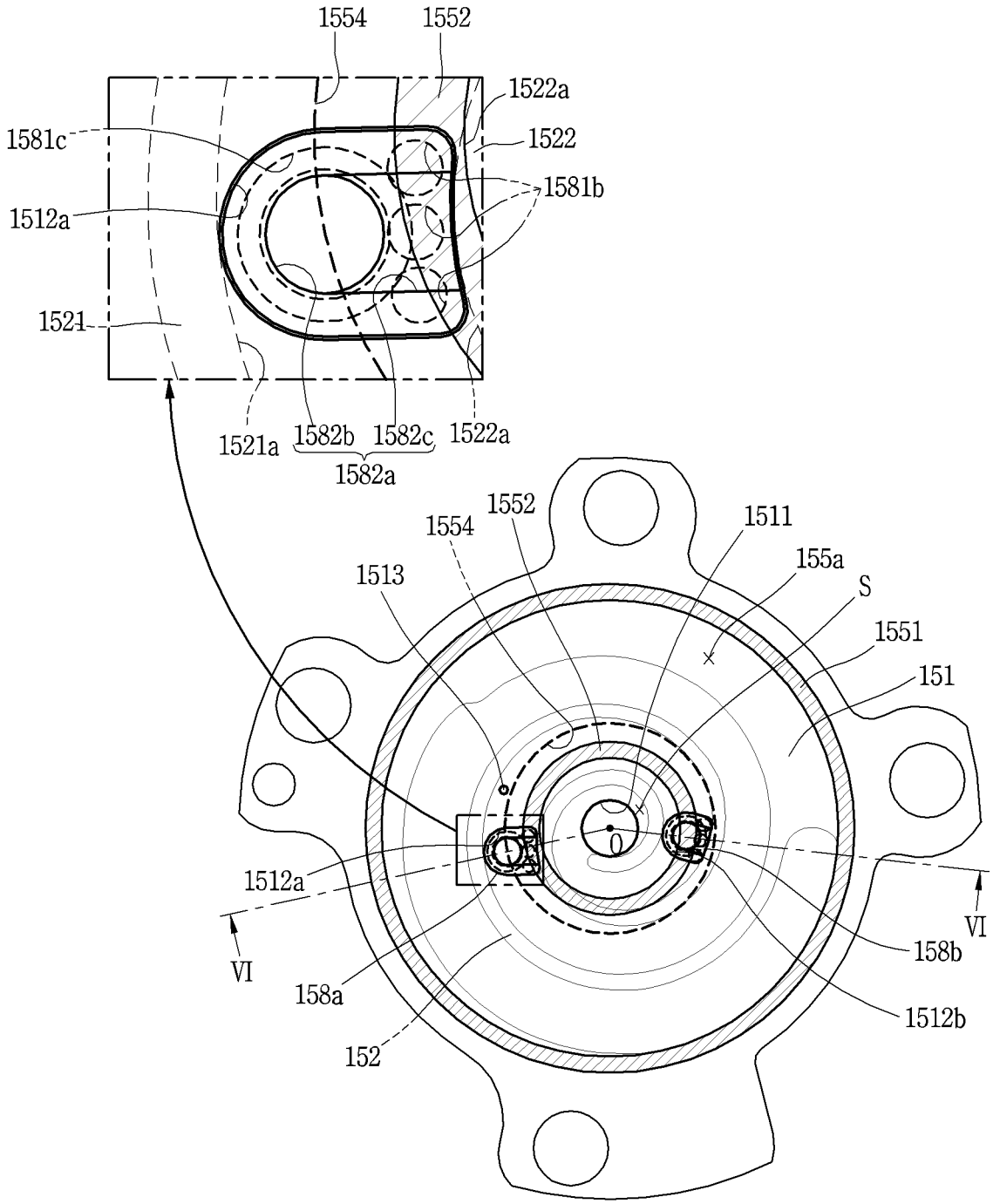
FIG. 10 is a plan view of FIG. 8.
Figure 11:
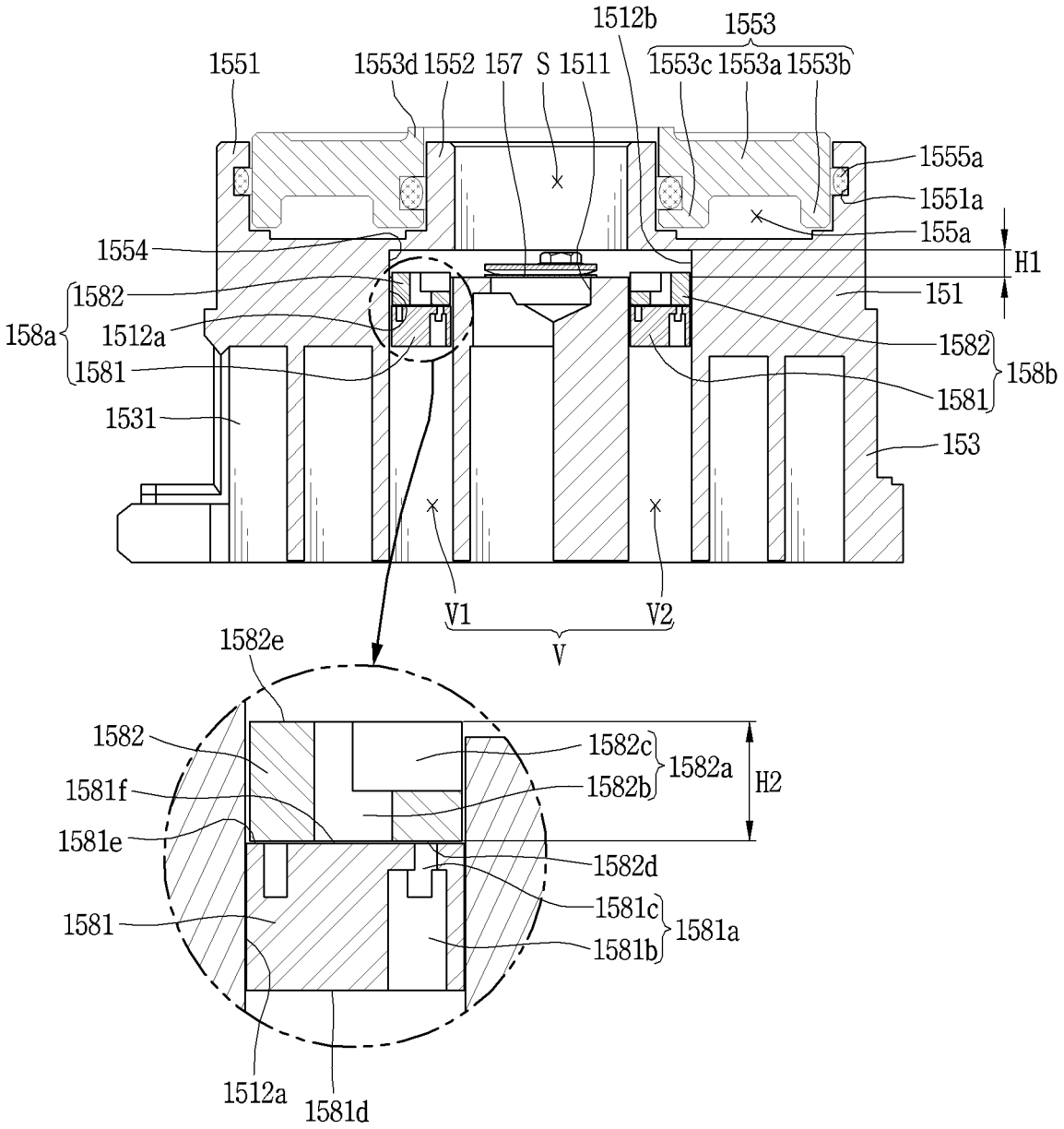
FIG. 11 is a cross-sectional view taken along line "VI-VI" of FIG. 10.
Figure 12:
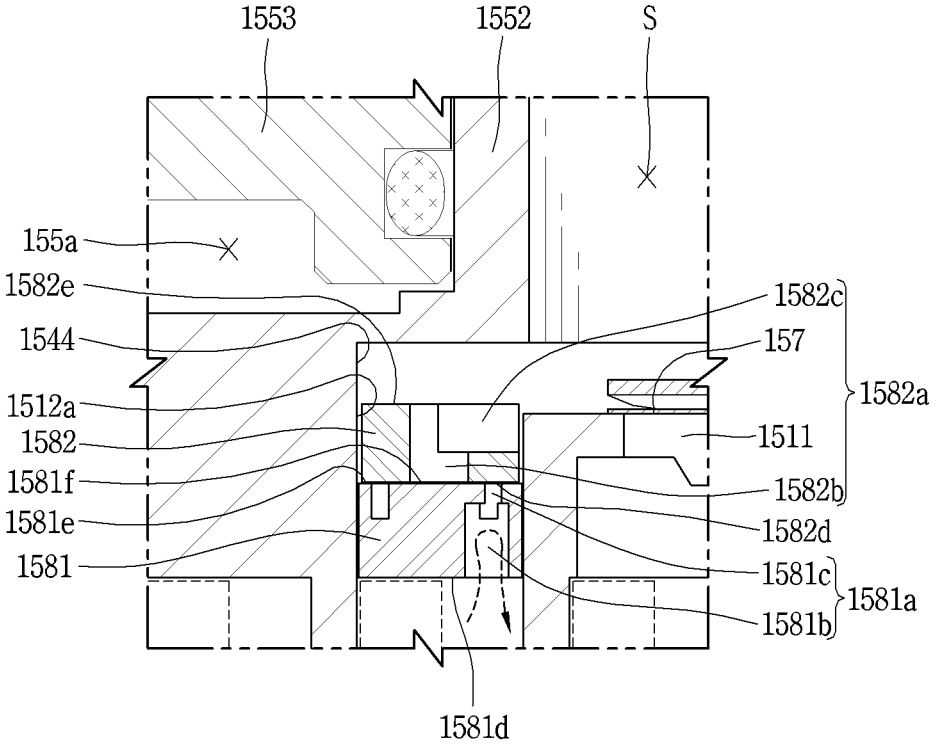
Figure 13:
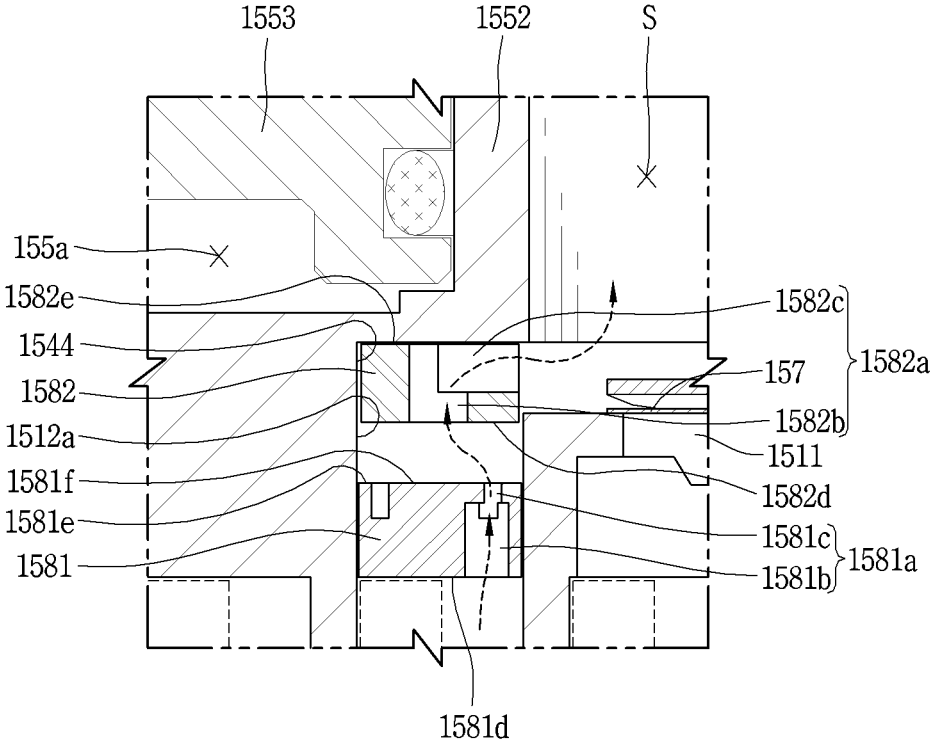

FIG. 8 is an exploded perspective view of another embodiment of a back pressure chamber portion in FIG. 1, FIG. 9 is an exploded perspective view of a bypass valve shown in FIG. 8, FIG. 10 is a plan view of FIG. 8, FIG. 11 is a cross-sectional view taken along line "VI-VI" of FIG. 10, and FIGS. 12 and 13 are cross-sectional views showing an operation of a bypass valve in FIG. 8.

Referring to FIGS. 8 to 11, the non-orbiting scroll 150 and the back pressure chamber part 155 according to the present embodiment are substantially similar to those of the embodiment described above. That is, in the non-orbiting scroll 150, the back pressure chamber outer wall 1551 and the back pressure chamber inner wall 1552 are integrally provided, and the floating plate 1553 is slidably inserted between the back pressure chamber outer wall 1551 and the back pressure chamber inner wall 1552 to form the back pressure chamber 155*a*. A discharge port 1511 is provided at the center of the non-orbiting end plate 151, a first bypass hole 1512*a* and a second bypass hole 1512*b* are provided around the discharge port 1511, and a back pressure hole 1513 is provided around the first bypass hole 1512*a* or the second bypass hole 1512*b*.

The discharge port 1511, the first bypass hole 1512*a*, the second bypass hole 1512*b*, and the back pressure hole 1513 may be provided at the same positions as those in the embodiment described above. For example, the discharge port 1511 may be provided on the same axial line with respect to the inner circumferential surface 1552*a* of the back pressure chamber inner wall 1552, and the back pressure hole may be provided at a position spaced apart from the outer circumferential surface of the back pressure chamber inner wall 1552 by a preset interval.

The first bypass hole 1512*a* and the second bypass hole 1512*b* may be provided at positions that overlap the back pressure chamber inner wall 1552 in the axial direction or at positions that do not overlap the back pressure chamber inner wall 1552 in the axial direction, for example, on an inner side than the inner circumferential surface 1552*a* of the back pressure chamber inner wall 1552. In this embodiment, an example in which the first bypass hole 1512*a* and the second bypass hole 1512*b* are provided at positions overlapping the back pressure chamber inner wall 1552 in the axial direction will be mainly described. However, the same may be applied to a case in which the first bypass hole 1512*a* and the second bypass hole 1512*b* are provided on an inner side than the inner circumferential surface 1552*a* of the back pressure chamber inner wall 1552.

When the first bypass hole 1512*a* and the second bypass hole 1512*b* are provided at positions overlapping the back pressure chamber inner wall 1552 in the axial direction, as described above, the first bypass hole 1512*a* and the second bypass hole 1512*b* may be blocked by the back pressure chamber inner wall 1552. Thus, in the present embodiment, a communicating recess portion 1554 as in the embodiment described above is provided on the inner circumferential surface 1552*a* of the back pressure chamber inner wall 1552.

Specifically, the communicating recess portion 1554 is provided in an annular shape and is depressed by a preset depth in the radial direction from the inner circumferential surface 1552*a* of the back pressure chamber inner wall 1552. In other words, the communicating recess portion 1554 extends in the axial direction and is provided to communicate with the discharge chamber S across the other ends of the first bypass hole 1512*a* and the second bypass hole 1512*b* having one end communicating with the compression chamber V.

For example, the inner circumferential side of the communicating recess portion 1554 is provided on the same axial line as the inner circumferential surface 1552*a* of the back pressure chamber inner wall 1552 and is opened toward the discharge chamber S, and the outer circumferential surface of the communicating recess portion 1554 may be provided across the first bypass hole 1512*a* and the second bypass hole 1512*b* in a radial direction to accommodate the first bypass hole 1512*a* and the second bypass hole 1512*b*. That is, an outer diameter D12 of the communicating recess portion 1554 connecting the outer circumferential surface of the communicating recess portion 1554 may be provided to be equal to or greater than a diameter D3 of a virtual circle having in which a distance to the first bypass hole 1512*a* or/and the second bypass hole 1512*b* based on the center O of the back pressure inner wall 1552 (or the center of the discharge port) as a radius. Accordingly, the first bypass hole 1512*a* and the second bypass hole 1512*b* may overlap the communicating recess portion 1554 in the axial direction. Through this, even if the first bypass hole 1512*a* and the second bypass hole 1512*b* are provided at positions overlapping the back pressure chamber inner wall 1552 in the axial direction, the compression chamber V forming an intermediate pressure and the discharge chamber S may communicate with each other by the bypass holes 1512*a* and 1512*b* and the communicating recess portion 1554.

Also, in this case, the first bypass valve 158*a* is installed inside the first bypass hole 1512*a* and the second bypass valve 158*b* is installed inside the second bypass hole 1512*b*, so that the refrigerant of the discharge chamber S is prevented from flowing back into the compression chamber V.

In the embodiment described above, the first bypass valve 158*a* and the second bypass valve 158*b* are installed at the outlet ends of the first bypass hole 1512*a* and the second bypass hole 1512*b*, that is, on an upper surface of the non-orbiting end plate 151 of the discharge chamber S, but in the present embodiment, the first bypass valve 158*a* is inserted into the first bypass hole 1512*a* and the second bypass valve 158*b* is inserted into the second bypass hole. Since the first bypass valve 158*a* and the second bypass valve 158*b* are provided to be the same as each other, the following description will focus on the first bypass valve 158*a* and the first bypass valve 158*a* and the second bypass valve 158*b* will be separately described only when necessary.

Referring to FIGS. 8 to 10, the first bypass valve 158*a* according to the present embodiment includes a first fixed member 1581 and a first valve member 1582. The first fixed member 1581 is inserted and fixed to a lower portion of the first bypass hole 1512*a*, and the first valve member 1582 is provided to be movable along the first bypass hole 1512*a* from an upper portion of the first bypass hole 1512*a* along the first bypass hole 1512*a*.

The first fixed member 1581 and the first valve member 1582 may be provided of the same material or different materials. However, since the first fixed member 1581 should be fixed to the first bypass hole 1512*a*, a material having a high thermal expansion coefficient is advantageous, while since the first valve member 1582 should slidably move in the first bypass hole 1512*a*, a light material having a low thermal expansion coefficient may be advantageous.

For example, the first fixed member 1581 may be provided of the same material as the non-orbiting scroll 150 or may be provided of a metal material having a higher thermal expansion coefficient than the non-orbiting scroll 150. Accordingly, even when high-temperature compression heat is generated in the compression chamber V during an operation of the compressor, movement or separation of the first fixed member 1581 in the first bypass hole 1512*a* may be effectively suppressed.

In addition, the first valve member 1582 may be provided of a material having a lower thermal expansion coefficient and being lighter than those of the first fixed member 1581, such as engineer plastic. Accordingly, thermal deformation of the first valve member 1582 may be suppressed and the weight of the first valve member 1582 may be reduced, and through this, the first valve member 1582 may more rapidly open the bypass passage substantially forming the first bypass hole 1512*a* to effectively suppress overcompression in the compression chamber V1.

Specifically, the first fixed member 1581 may be provided in a circular shape or may be provided in a curved shape similar to a circular shape. Alternatively, the first fixed member 1581 may be provided in an angular shape such as a quadrangle. In other words, the first fixed member 1581 may be a shape having a width sufficient to completely seal the first bypass hole 1512*a*.

The shape of the first fixed member 1581 may be the same as that of the first bypass hole 1512*a*. For example, when the first bypass hole 1512*a* is provided as a single circular hole, the first fixed member 1581 may also have a single circular cross-sectional shape. However, as in the present embodiment, when a plurality of holes smaller than a wrap thickness should be provided at preset intervals in a moving direction of the non-orbiting wrap 152 near the non-orbiting wrap 152, the first bypass hole 1512*a* may be provided as a single circular cross-section greater than the wrap thickness, may be provided as a long-hole cross-section, or may have a polymorphic cross-section in which a circular cross-section and a long-hole cross-section are mixed. In this embodiment, the first bypass hole 1512*a* having a polymorphic cross-sectional shape will be described as an example.

The first bypass hole 1512*a* is provided between the main surfaces of both non-orbiting wraps 152 facing in the radial direction, that is, between the inner circumferential surface 1521*a* of the outer non-orbiting wrap 1521 and the outer circumferential surface 1522*b* of the inner non-orbiting wrap 1522. Accordingly, a radial width of the first bypass hole 1512*a* is substantially equal to the inter-wrap distance defined as an interval between the inner circumferential surface 1521*a* of the outer non-orbiting wrap 1521 and the outer circumferential surface 1522*b* of the inner non-orbiting wrap 1522. However, in some cases, a radial width of the first bypass hole 1512*a* may be provided smaller than the inter-wrap distance within a range that may include the preset positions of the bypass holes 1512*a* and 1512*b*.

For example, the first bypass hole 1512*a* according to the present embodiment may have a substantially U-shaped cross-sectional shape. In other words, a radially outer side of the first bypass hole 1512*a* is located in the same line in the axial direction on the inner circumferential surface 1521*a* of the outer non-orbiting wrap 1521 to be provided in a shape similar to that of point contact, and a radially inner side of the first bypass hole 1512*a* is located in the same line in the axial direction on the outer circumferential surface 1552*b* of the inner non-orbiting wrap 1522 to be provided in a shape similar to that of a line contact. Accordingly, even if a first fixed discharge passage 1581*a* to be described later substantially constituting the bypass holes 1512*a* and 1512*b* is provided of a plurality of holes arranged along the moving direction of the non-orbiting wrap 152, the holes may all be accommodated inside the first fixed member 1581.

In addition, the circumferential side surfaces of the first bypass hole 1512*a* may be provided to be parallel to each other or may be provided in an outwardly convex curved surface shape. When the circumferential side surfaces of the first bypass hole 1512*a* are provided to be parallel to each other, a friction area of the first valve member 1582 to be described later with the circumferential side surface may be minimized, and when the circumferential side surfaces of the first bypass hole 1512*a* are provided to have a convex curved surface shape, a fixing area between the first fixed member 1581 and the first bypass hole 1512*a* to be described later and a support area between the first fixed member 1581 and the orbiting wrap 142 may be enlarged, so that assembly reliability for the first fixed member 1581 may be improved.

Referring to FIGS. 8 to 10, the first fixed member 1581 may be provided in the same shape as the first bypass hole 1512*a*, that is, in a substantially U-shaped cross-sectional shape. Accordingly, as described above, the first fixed member 1581 may be press-fitted into the first bypass hole 1512*a* to be firmly fixed.

For example, one point on the outer surface of the first fixed member 1581 is located in the same line in the axial direction on the inner circumferential surface 1521*a* of the outer non-orbiting wrap 1521, and the inner surface of the first fixed member 1581 is almost entirely located in the same line in the axial direction on the outer circumferential surface 1522*b* of the inner non-orbiting wrap 1522. In other words, the outer surface of the first fixed member 1581 may be provided to be convex from the center of the first fixed member 1581 to the outside, and the inner surface of the first fixed member 1581 may be provided to be concave from the outside to the center. Accordingly, the first fixed discharge passage 1581*c* having a plurality of holes smaller than the wrap thickness may be provided at preset intervals on the inner surface of the first fixed member 1581 along the non-orbiting wrap 152.

The circumferential side surface of the first fixed member 1581 may be provided to be substantially parallel. However, the circumferential side surface of the first fixed member 1581 may be provided in an outwardly convex curved shape. When the circumferential side surface of the first fixed member 1581 is provided in an outwardly convex curved shape, an outer circumferential length of the first fixed member 1581 increases, so that a fixed area in close contact with the first bypass hole 1512*a* is enlarged. In addition, a support area overlapping the orbiting wrap 142 in the axial direction may be enlarged, so that assembly reliability of the first fixed member 1581 may be improved.

A first fixed discharge passage 1581*a* substantially forming a portion of the first bypass passage is provided on an inner side of the first fixed member 1581. The first fixed discharge passage 1581*a* is provided to penetrate through both side surfaces of the first fixed member 1581 in the axial direction. Accordingly, the first fixed discharge passage 1581*a* forms a substantial first bypass passage together with a first valve discharge passage 1582*a* to be described later when the first valve member 1582 is spaced apart from the first fixed member 1581.

Specifically, the first fixed discharge passage 1581*a* includes a first fixed discharge port 1581*b* and a first fixed discharge recess 1581*c*.

The first fixed discharge port 1581*b* penetrates from a lower end to an upper end of the first fixed member 1581 and includes a plurality of holes smaller than the wrap thickness. The plurality of first fixed discharge ports 1581*b* are provided at preset intervals along the moving direction of the wrap.

Although not shown in the drawings, the first fixed discharge port 1581*b* may include a single hole, and in this case, the first fixed discharge port 1581*b* may be provided in a long hole shape along the wrap.

The first fixed discharge recess 1581*c* is provided to be depressed by a preset depth in a first side of the first fixed member 1581 facing the first valve member 1582. The first fixed discharge recess 1581*c* is provided to communicate with the first fixed discharge port 1581*b* and may be provided in a circular shape or an annular shape. This embodiment shows an example in which the first fixed discharge recess 1581*c* is provided in an annular shape.

For example, the first fixed discharge recess 1581*c* may be provided in an annular shape along a circumference of a second side 1581*e* of the first fixed member 1581. Accordingly, all of the plurality of first fixed discharge ports 1581*b* may communicate with the first fixed discharge recess 1581*c*.

Meanwhile, referring to FIGS. 9 and 11, first opening/closing protrusions 1581*f* and 1581*h* blocking the first valve discharge passage 1582*a* to be described later are provided on an outlet side of the first fixed discharge passage 1581*a*.

The first opening/closing protrusion 1581*f* may protrude from a central portion of the first fixed member 1581 by a preset height, and may be provided at a height capable of blocking the first valve discharge passage 1582*a* to be described later. For example, the first opening/closing protrusion 1581*f* may be provided to have the same height as the outer surface of the first fixed discharge recess 1581*c*, that is, to form the same plane as the second side surface 1281*h* of the first fixed member 1581.

In other words, the first opening/closing protrusion 1581*f* may be provided as an inner surface of the first fixed discharge recess 1581*c* remaining as the first fixed discharge recess 1581*c* is provided to be depressed in an annular shape from a first side surface 1581*d*. Accordingly, when the first valve member 1582 is pressed by the pressure of the discharge chamber S and the second side 1581*e* of the first valve member 1582 comes into contact with the first side surface 1581*d* of the first fixed member 1581, an inlet end of the first valve discharge passage 1582*a* to be described later is in close contact with the upper surface of the first opening/closing protrusion 1581*f*, thereby blocking between the first fixed discharge passage 1581*a* substantially forming the first bypass hole 1512*a* and the first valve discharge passage 1582*a*.

Referring to FIGS. 9 to 11, an axial shape (planar shape) of the first valve member 1582 according to the present embodiment may be the same as or substantially the same as an axial shape of the first fixed member 1581. For example, like the first fixed member 1581, the first valve member 1582 may be provided in a U-shaped cross-sectional shape in which the outer surface is convex and the inner surface is concave. Accordingly, the first bypass hole 1512*a* may be provided in a single shape, so that the first bypass hole 1512*a* may be easily provided as much.

In addition, an axial cross-sectional area of the first valve member 1582 may be the same as or substantially equal to an axial cross-sectional area of the first fixed member 1581. However, the axial cross-sectional area of the first valve member 1582 may be slightly smaller than the axial cross-sectional area of the first fixed member 1581. Accordingly, while the first fixed member 1581 is press-fitted into the first bypass hole 1512*a* to be fixed, the first valve member 1582 may detachably attached to the first fixed member 1581, while sliding in the first bypass hole 1512*a* in the axial direction.

However, depending on a shape of the first bypass hole 1512*a*, the axial cross-sectional area of the first valve member 1582 may be greater than or equal to the axial cross-sectional area of the first fixed member 1581. For example, the first bypass hole 1512*a* may be provided in a two-stage shape, and when a cross-sectional area of a second stage (no reference numeral given) in which the first valve member 1582 is accommodated is provided to be larger than a cross-sectional area of a first stage (no reference numeral given) in which the first fixed member 1581 is accommodated, the first valve member 1582 may also be provided to be greater than the first fixed member 1581.

Although not shown in the drawings, the first stage may have a U-shaped cross-section as in the embodiment described above, and the second stage may have a circular cross-section. In this case, the first fixed member 1581 may have a U-shaped cross-section corresponding to the first stage, and the first valve member 1582 may have a circular cross-sectional shape corresponding to the second stage. In this case, as the first valve member 1582 is provided to be wider than the first fixed member 1581, the first fixed discharge passage 1581*a* may be more effectively blocked. However, when the first valve member 1582 is circular, a D-cut surface may be provided on one side of the outer circumferential surface to prevent the first valve member 1582 from rotating at the second stage.

In addition, a thickness H2 of the first valve member 1582, that is, an axial length may be greater than or equal to an axial height H1 of the communicating recess portion 1554, preferably, greater than the axial height H1 of the communicating recess portion 1554. For example, if the thickness H2 of the first valve member 1582 is provided to be smaller than the axial height H1 of the communicating recess portion 1554, a lower end of the first valve member 1582 facing the first fixed member 1581 is placed in the communicating recess portion 1554 when the first valve member 1582 is opened. However, since the communicating recess portion 1554 is provided in an annular shape and is open in the circumferential direction, the first valve member 1582 may not be constrained by the communicating recess portion 1554 and may eventually escape from the first bypass hole 1512*a*. However, when the thickness H2 of the first valve member 1582 is greater than the axial height H1 of the communicating recess portion 1554 as in the present embodiment, the first valve member 1582 may be restrained from escaping from the first bypass hole 1512*a* even if the communicating recess portion 1554 is provided in an annular shape.

The first valve discharge passage 1582*a* forming another portion of the substantially first bypass passage is provided in the central portion of the first valve member 1582. The first valve discharge passage 1582*a* is provided to penetrate through both side surfaces of the first valve member 1582 in the axial direction. Accordingly, the first valve discharge passage 1582*a* forms a substantial first bypass passage together with the first fixed discharge passage 1581*a* described above when the first valve member 1582 is spaced apart from the first fixed member 1581.

Specifically, the first valve discharge passage 1582*a* may include a first valve discharge port 1582*b* and a first valve discharge recess 1582*c*.

The first valve discharge port 1582*b* may be provided to penetrate in an axial direction from an approximately central portion of the first valve member 1582. The first valve discharge port 1582*b* may be provided on the same axial line as the first opening/closing protrusion 1581*f* of the first fixed member 1581, and an inner diameter of the first valve discharge port 1582*b* may be provided to be smaller than or equal to an outer diameter of the first opening/closing protrusion 1581*f* Accordingly, when the first valve member 1582 is closed, the first valve discharge port 1582*b* is in close contact with the first opening/closing protrusion 1581*f* of the first fixed member 1581 to block the first fixed discharge passage 1581*a* and the first valve discharge passage 1582*a* forming a first bypass passage.

The first valve discharge recess 1582*c* may be depressed in the axial direction from one side of the first valve member 1582 to extend radially. For example, the first valve discharge recess 1582*c* may be provided to penetrate in the radial direction, or may be provided to extend radially from the central portion of the first valve member 1582 to the outer circumferential surface toward the discharge chamber S. In an example of the first valve discharge recess 1582*c* according to the present embodiment, one end forming an inner end is provided up to the first valve discharge port 1582*b* and one end forming an outer end is opened to the outer circumferential surface of the first valve member 1582.

In other words, the inner end of the first valve discharge recess 1582*c* communicates with the first valve discharge port 1582*b*, and the outer end of the first valve discharge recess 1582*c* communicates with the discharge chamber S. Accordingly, the first valve discharge port 1582*b* communicates with the discharge chamber S through the first valve discharge recess 1582*c*.

Also, the first valve discharge recess 1582*c* may be provided on a first side surface 1582*d* of the first valve member 1582 facing the first fixed member 1581. However, it may be preferable for the first valve discharge recess 1582*c* to be depressed by a preset depth toward the discharge chamber S from the second side surface 1582*e*, which is the axially opposite surface of the first side surface 1582*d*. Accordingly, when the pressure in the discharge chamber S is higher than the pressure in the compression chamber V, the refrigerant in the discharge chamber S is guided to the first valve discharge recess 1582*c* to press the first valve member 1582 in a closing direction, that is, toward the first fixed member 1581. Then, when the pressure in the discharge chamber S is higher, that is, when normal discharge is provided, the first valve member 1582 may be rapidly closed so that the refrigerant in the discharge chamber S is prevented from flowing back to the compression chamber V constituting the intermediate pressure chamber.

Although not shown in the drawings, the first valve discharge recess 1582*c* may be provided in a hole shape at an intermediate height of the first valve member 1582. In other words, the first valve discharge port 1582*b* is provided to penetrate through between the first side surface and the second side surface of the first valve member 1582, and the first valve discharge port 1582*c* may be provided to penetrate through the outer circumferential surface of the first valve member 1582 in the middle of the first discharge port 1582*b*. Even in this case, the first valve discharge port 1582*b* and the first valve discharge recess 1582*c* may form a portion of the first bypass passage.

In the drawings, reference numeral 1586 denotes a second valve member.

The first bypass valve according to the present embodiment as described above is operated as follows.

That is, as shown in FIG. 12, when the compressor is stopped, the pressure in the discharge chamber S is equal to the pressure in the compression chamber V. Then, the first valve member 1582 descends by self-load to be placed on the upper surface of the first fixed member 1581. Then, a portion between the first fixed discharge passage 1581*a* of the first fixed member 1581 and the first valve discharge passage 1582*a* of the first valve member 1582 is blocked, so that the first bypass hole 1512*a* remains closed while the compressor is stopped.

However, as shown in FIG. 13, when the compressor is in operation, the pressure in the compression chamber V increases, so that a pressure difference is generated between the compression chamber V and the discharge chamber S. Then, as the first bypass valve 158*a* described above, as well as the discharge valve 157 for opening and closing the discharge port 1511, is opened and closed by the pressure difference between the compression chamber V and the discharge chamber S, and the refrigerant of the compression chamber V is discharged to the discharge chamber S.

For example, when the pressure of the first compression chamber V1 constituting the intermediate pressure chamber is excessively increased to be higher than a set pressure (or the pressure of the discharge chamber), the refrigerant in the first compression chamber V1 moves to the first fixed discharge port 1581*b* and the first fixed discharge recess 1581*c* of the first fixed member 1581, and the refrigerant presses the first valve member 1581 in an opening direction.

Then, the first valve member 1582 is pushed up by the pressure of the first compression chamber V1 constituting the intermediate pressure chamber and rises along the first bypass hole 1512*a*, so that the first valve discharge port 1582*b* is separated from the first opening/closing protrusion 1581*f* to be opened. Then, a portion of the refrigerant in the first compression chamber V1 is bypassed to the discharge chamber S through the first fixed discharge passage 1581*a* and the first valve discharge passage 1582*a*. Then, the pressure in the first compression chamber V constituting the intermediate pressure chamber is lowered to an appropriate pressure, so that the overcompression in the first compression chamber V1 is eliminated.

Thereafter, when the pressure of the first compression chamber V1 is lowered to an appropriate pressure and the pressure of the first compression chamber V is lower than the pressure of the discharge chamber S, the first valve member 1582 is pushed to be lowered by the self-load of the valve and the pressure of the discharge chamber S. At this time, as the first valve discharge recess 1582*c* is provided to be depressed in the second side surface 1582*e* of the first valve member 1582, the first valve discharge recess 1582*c* is exposed to the discharge chamber S even when the second side surface 1582*e* of the first valve member 1582 is in close contact with the upper surface of the communicating recess portion 1554. Accordingly, the first valve discharge recess 1582*c* serves as a kind of first pressing recess, so that the refrigerant in the discharge chamber S is rapidly introduced between the second side surface 1582*e* of the first valve member 1582 and the upper surface of the communicating recess portion 1554, so that the first valve member 1582 may quickly move in a closing direction.

Then, as shown in FIG. 12, the first valve member 1582 is in close contact with the first fixed member 1581 so that the first valve discharge port 1582*b* of the first valve member 1582 is in close contact with the first opening/closing protrusion 1581*f* of the first fixed member 1581 to block the first bypass hole 1512*a*. Then, backflow of the refrigerant in the discharge chamber S to the first compression chamber V1 constituting the intermediate pressure chamber is suppressed during a normal operation.

Meanwhile, as described above, the second bypass valve 158*b* is provided to be substantially the same as the first bypass valve 158*a*, and the effect thereof is also substantially the same. Accordingly, the description of the second bypass valve 158*b* is replaced with the description of the first bypass valve 158*a*.

However, while the first bypass valve 158*a* communicates with the first compression chamber V1, the second bypass valve 158*b* may communicate with the second compression chamber V2. Accordingly, while the first fixed discharge port 1581*b* of the first bypass valve 158*a* is provided to be adjacent to the outer circumferential surface 1522*b* of the inner non-orbiting wrap 1522, the second fixed discharge port 1585*b* of the second fixed member 1585 forming the second bypass valve 158*b* is provided to be adjacent to the inner circumferential surface 1521*a* of the outer non-orbiting wrap 1521. Accordingly, in the first bypass valve 158*a* according to the present embodiment, the outer surface of the first fixed member 1581 is provided to be convex and the inner surface is provided to be concave, whereas, in the second bypass valve 158*b*, both the outer and inner surfaces of the second fixed member 1585 are provided to be convex.

As described above, when the first bypass valve 158*a* and the second bypass valve 158*b* are inserted into the respective bypass holes 1512*a* and 1512*b*, the first side surface 1581*d* of the first fixed member 1581 and the first side surface 1582*d* of the second fixed member 1585 forming a lower end of the first bypass valve 158*a* and a lower end of the second bypass valve 158*b* form the same height as that of the inner side surface of the non-orbiting end plate 151 forming an upper surface of each of the compression chambers V1 and V2. Accordingly, the length of the first fixed discharge passage 1581*a* substantially forming the first bypass hole 1512*a* and the length of the second fixed discharge passage 1582*d* substantially forming the second bypass hole 1512*b* are shortened, thereby reducing a dead volume due to the bypass hole as much.

In addition, when the first bypass valve 158*a* and the second bypass valve 158*b* are inserted into the respective bypass holes 1512*a* and 1512*b*, each of the bypass holes 1512*a* and 1512*b* may be connected to the discharge chamber S, while a radial depth or an axial height of the communicating recess portion 1554 is provided to be small, compared with the embodiment described above. Accordingly, the communicating recess portion 1554 may be easily machined on the inner circumferential surface 1552*a* of the back pressure chamber inner wall 1552.

In addition, as the first bypass valve 158*a* and the second bypass valve 158*b* are inserted into the respective bypass holes 1512*a* and 1512*b*, the bypass valves 158*a* and 158*b* may be easily installed, compared to the embodiment described above.

In addition, as the bypass valve is excluded from the upper surface of the non-orbiting end plate 151, space utilization for the upper surface of the non-orbiting end plate 151 may be increased and flow resistance of the discharged refrigerant is reduced, so that the refrigerant may be discharged quickly.

Although not shown in the drawings, in this embodiment, two or more pairs of bypass holes 1512 and the bypass valves 158 may be provided. For example, in the embodiment described above, an example in which only one bypass hole 1512 and one bypass valve 158 are provided in the first compression chamber V1 and the second compression chamber V2 at positions corresponding to each other is illustrated. This is because, in the case of the non-orbiting back pressure method, it is not easy to secure enough space to include the bypass hole 1512 and the bypass valve 158 as the back pressure chamber part 155 is provided on the upper surface of the non-orbiting end plate 151. However, when the bypass valve 158 is inserted into each bypass hole 1512 as in the present embodiment, interference between the bypass valves 158 may be minimized, so that the bypass hole 1512 and the bypass valve 158 may be further provided. Then, overcompression may be more effectively suppressed and the operation range of the compressor may be variably controlled.

Meanwhile, another embodiment of the back pressure chamber including the bypass valve is as follows.

That is, in the embodiment described above, the communicating recess portion is provided in an annular shape, but in some cases, the communicating recess portion may be provided in a linear shape penetrated in the radial direction.

Figure 14:
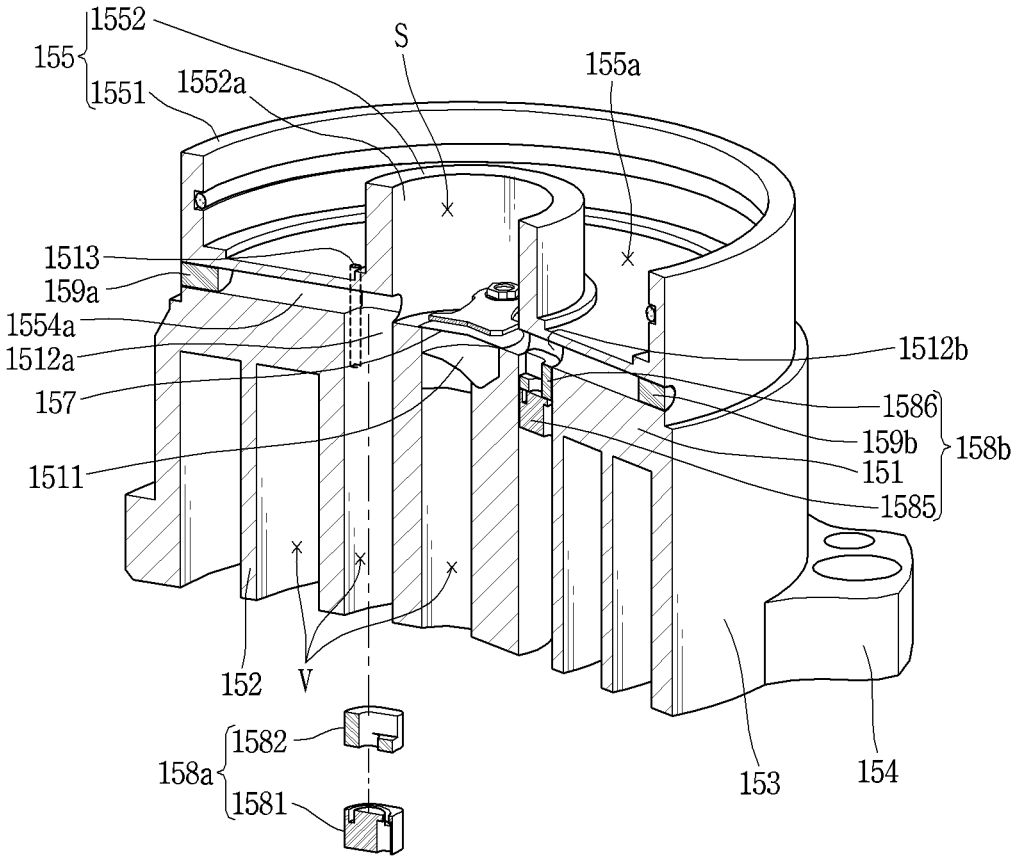
FIG. 14 is an exploded perspective view of another embodiment of a back pressure chamber part in FIG. 1.
Figure 15:
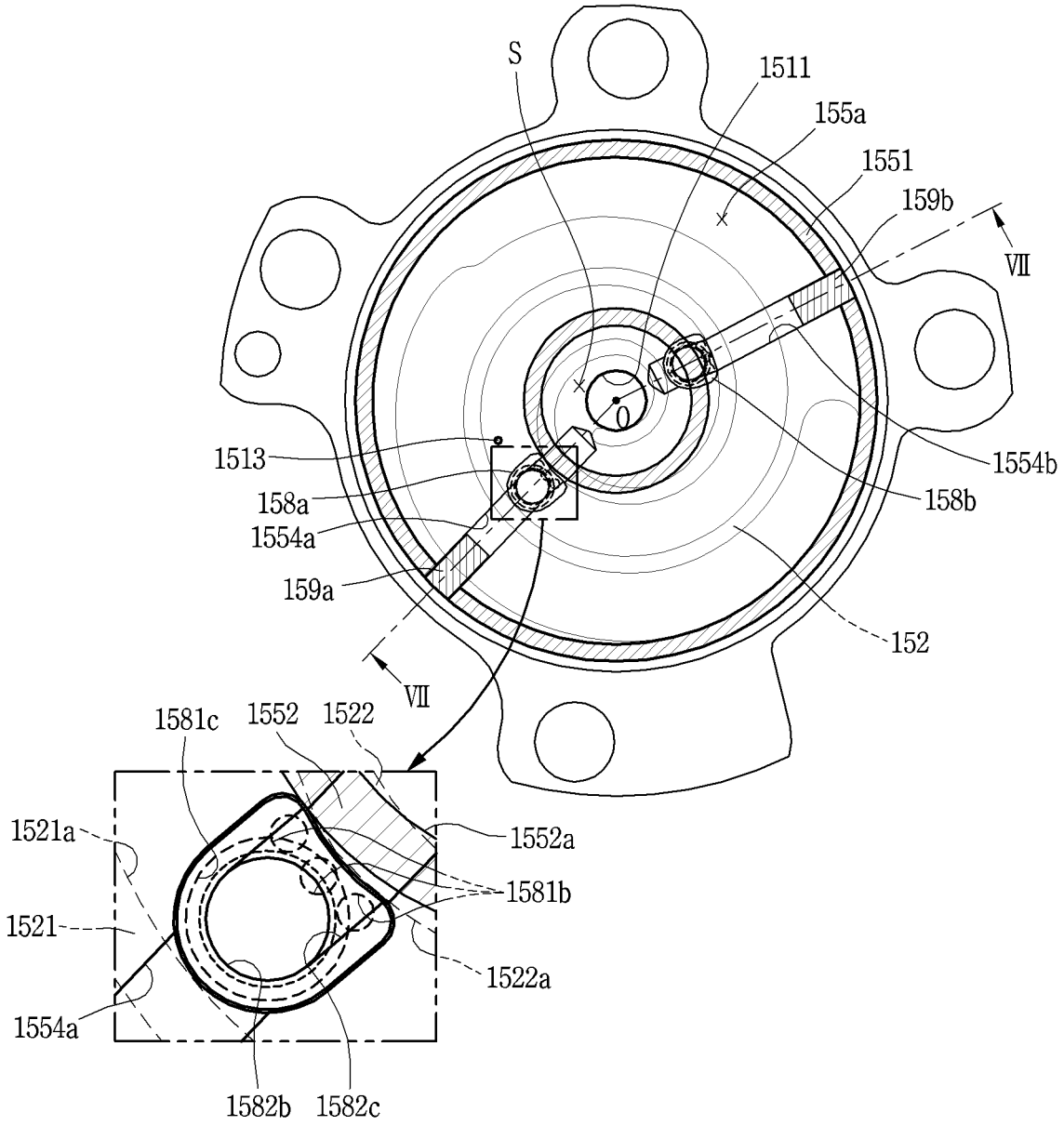
FIG. 15 is a plan view of FIG. 14.
Figure 16:
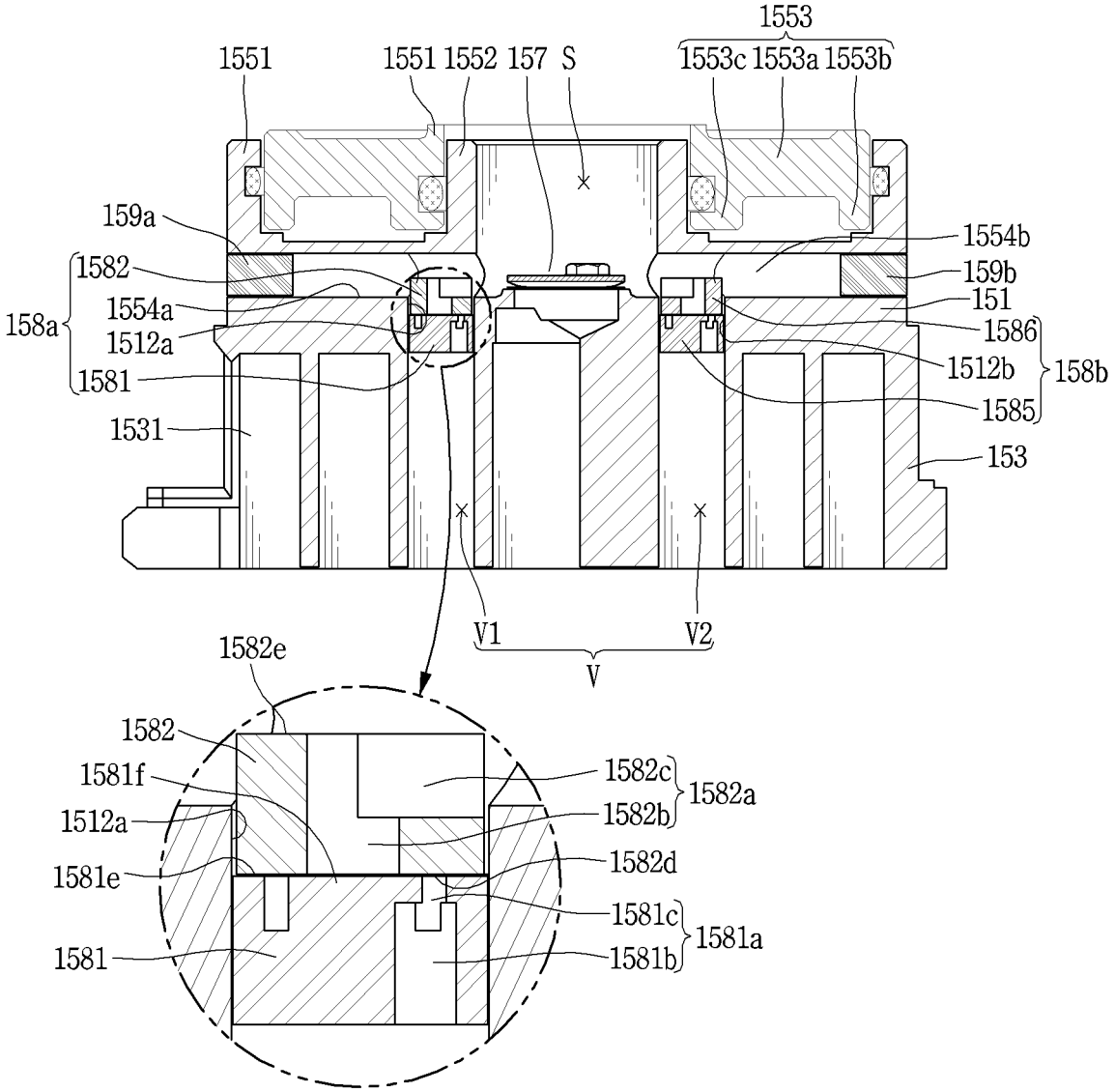
FIG. 16 is a cross-sectional view taken along line "VII-VII" of FIG. 15.
Figure 17:
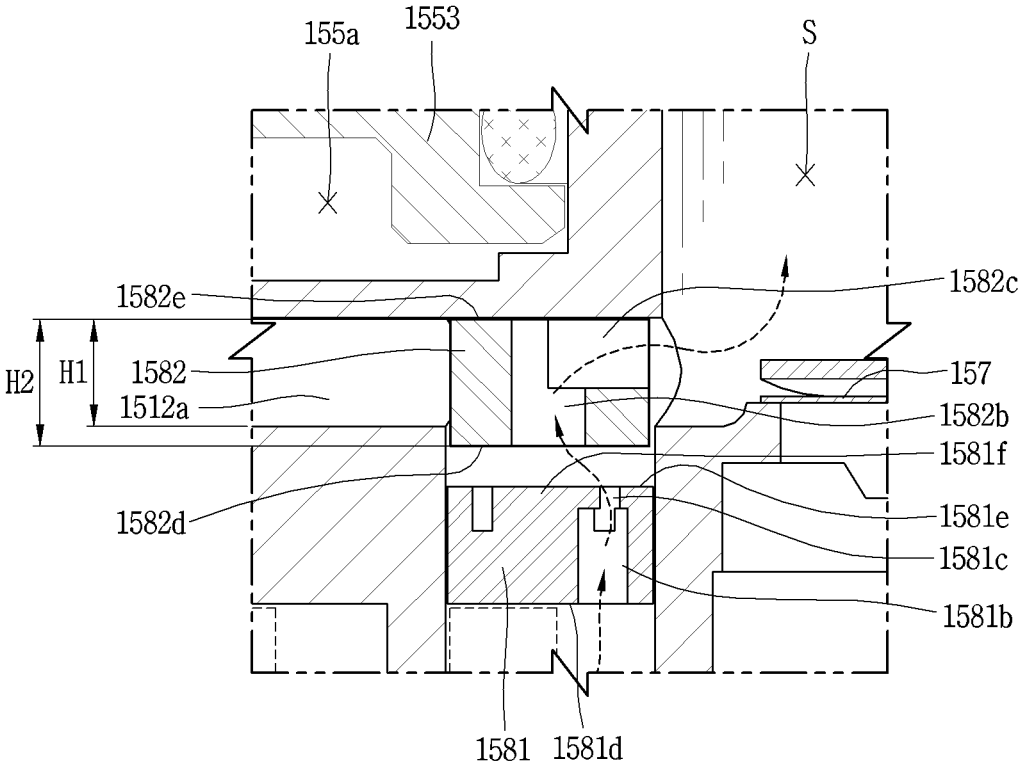
FIG. 17 is a cross-sectional view showing an operation of the bypass valve in FIG. 16.

FIG. 14 is an exploded perspective view of another embodiment of a back pressure chamber portion in FIG. 1, FIG. 15 is a plan view of FIG. 14, FIG. 16 is a cross-sectional view taken along line "VII-VII" of FIG. 15, and FIG. 17 is a cross-sectional view showing an operation of the bypass valve in FIG. 16.

Referring to FIGS. 14 to 17, a basic configuration of the back pressure chamber part 155 according to the present embodiment and the effects thereof are similar to those of the embodiment described above. In other words, in the back pressure chamber part 155 according to the present embodiment, the back pressure chamber outer wall 1551 and the back pressure chamber inner wall 1552 forming both side surfaces and a lower side surface of the back pressure chamber 155*a* extend as a single body from an upper surface of the non-orbiting end plate 151, and a floating plate 1553 forming an upper side surface of the back pressure chamber 155*a* may be slidably inserted into the inner circumferential surface of the back pressure chamber outer wall 1551 and the outer circumferential surface of the back pressure inner wall 1552 or may be slidably inserted into the inner circumferential surface of the back pressure outer wall 1551 and the inner circumferential surface 1552*a* of the back pressure inner wall 1552. Although not shown in the drawings, the floating plate 1553 may be slidably inserted into the outer circumferential surface of the back pressure chamber outer wall 1551 and the inner circumferential surface 1552*a* of the back pressure chamber inner wall 1552 or slidably inserted into the outer circumferential surface of the back pressure outer wall 1551 and the outer circumferential surface of the back pressure inner wall 1552.

Hereinafter, for convenience, an example in which the floating plate 1553 is slidably inserted into the inner circumferential surface of the back pressure chamber outer wall 1551 and the outer circumferential surface of the back pressure chamber inner wall 1552 will be mainly described. In this case, since the back pressure chamber inner wall 1552 is provided to be closer to the discharge port 1511 than the first bypass hole (or/and the second bypass hole) 1512*a*, the first bypass hole (or/and the second bypass hole) 1512*a* is separated from the discharge chamber S by the back pressure chamber inner wall 1552. Accordingly, the first bypass hole (or/and the second bypass hole) 1512*a* and the discharge chamber S may communicate with each other by the communicating recess portion 1554 as in the embodiment described above. Unlike the embodiment described above, the communicating recess portion 1554 according to this embodiment is provided in a linear shape, and may be provided in plurality to independently communicate with the bypass holes 1512*a* and 1512*b*.

Referring to FIGS. 14 to 16, communicating recess portions 1554*a* and 1554*b* according to the present embodiment may be provided in plurality, and the communicating recess portions 1554*a* and 1554*b* may independently communicate with the bypass hole 1512*a* and 1512*b*, respectively. For example, the first communicating recess portion 1554*a* and the second communicating recess portion 1554*b* are spaced apart from each other by a preset interval in the circumferential direction, and the first communicating recess portion 1554*a* may communicate with the first bypass hole 1512*a*, and the second communicating recess 1554*b* may communicate with the second bypass holes 1512*b*.

Specifically, the first communicating recess portion 1554*a* and the second communicating recess portion 1554*b* may be provided to penetrate through the inner circumferential surface 1552*a* of the back pressure inner wall 1552 toward the discharge chamber S from the outer circumferential surface of the non-orbiting scroll 150, and in this case, the first communicating recess portion 1554*a* may be provided to pass across the first bypass hole 1512*a* and the second communicating recess portion 1554*b* may be provided to pass across the second bypass hole 1512*b*. Accordingly, the first bypass hole 1512*a* may communicate with the discharge chamber S by the first communicating recess portion 1554*a*, and the second bypass hole 1512*b* may communicate with the discharge chamber S by the second communicating recess portion 1554*b*. However, the stopper members 159*a* and 159*b* press-fitted to an outer end of the first communicating recess portion 1554*a* and an outer end of the second communicating recess portion 1554*b* to prevent leakage of the refrigerant of the compression chamber V or the discharge chamber S to the low-pressure part 110*a* through the respective communicating recess portions 1554*a* and 1554*b*.

In addition, the communicating recess portions 1554*a* and 1554*b* are provided in a circular cross-sectional shape, and the inner diameter of the communicating recess portions 1554*a* and 1554*b* may be provided to be greater than or equal to a circumferential width of the valve discharge passages 1582*a* and 1586*a* of the valve members 1582 and 1586, for example, substantially equal to a circumferential width of the first valve discharge recess 1582*c* (no reference numeral given).

The axial height H1 of the first communicating recess portion 1554*a* may be smaller than or equal to the axial thickness H2 of the first valve member 1582. For example, as shown in FIG. 17, the axial height H1 of the first communicating recess portion 1554*a* may be provided to be smaller than the axial thickness H2 of the first valve member 1582, that is, the axial thickness H2 of the first valve member 1582 may be provided to be greater than the axial height H1 of the first communicating recess portion 1554*a*.

Also, in this case, the first valve discharge passage 1582*a* as described above is provided in the first valve member 1582. Accordingly, even if the first valve member 1582 is not spaced apart from the lower surface of the first communicating recess portion 1554*a*, the first bypass hole 1512*a* may communicate with the discharge chamber S by the first valve discharge passage 1582*a*, so that the refrigerant in the compression chamber V may be smoothly bypassed to the discharge chamber S.

In addition, in this case, even if the first valve member 1582 moves to a top dead center, which is a maximum open position, a lower half of the first valve member 1582 remains in the first bypass hole 1512*a*, so that a possibility that the first valve member 1582 escapes from the first bypass hole 1512*a* when the first valve member 1582 is opened and closed is almost eliminated. Accordingly, the operation reliability of the first bypass valve 158*a* may be improved.

This is also the same for the second communicating recess portion 1554*b*.

However, in the first bypass valve 158*a*, the axial thickness H2 of the first valve member 1582 constituting a movable member may be provided to be smaller than the axial height H1 of the first communicating recess portion 1554*a*. Accordingly, the weight of the first valve member 1582 may be reduced to increase a valve response speed, and through this, the first bypass hole 1512*a* may be quickly opened and closed to suppress overcompression in the compression chamber V or backflow from the discharge chamber S into the compression chamber may be quickly suppressed.

The first bypass valve 158*a* according to the present embodiment may be inserted into the first bypass hole 1512*a*, and the second bypass valve 158*b* may be inserted into the first bypass hole 1512*a* to be coupled. Since this is almost the same as that of the embodiment described above of FIG. 8, a detailed description thereof is replaced with the description of the embodiment of FIG. 8.

Figure 18:
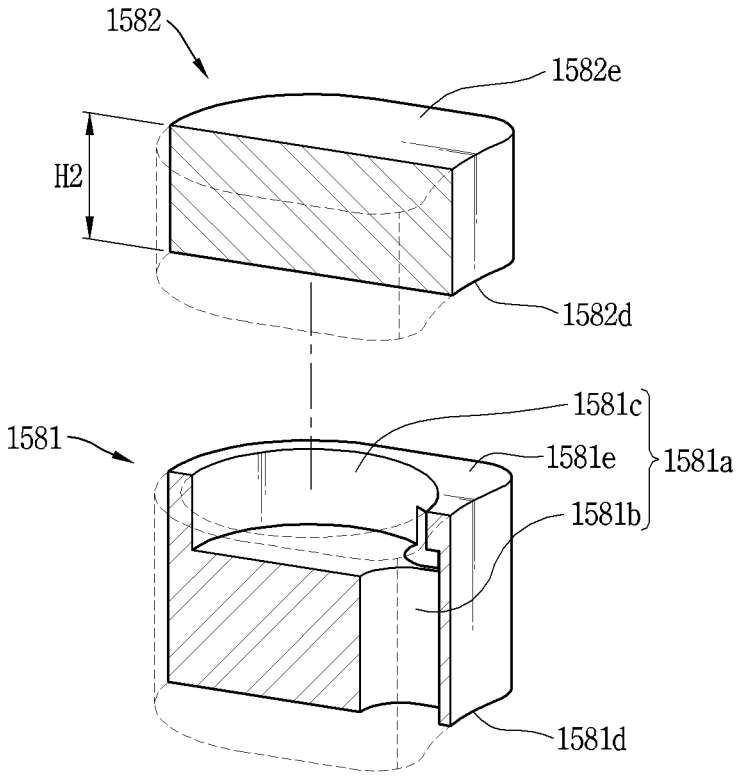
FIG. 18 is an exploded perspective view showing another embodiment of a bypass valve in FIG. 14.
Figure 20:
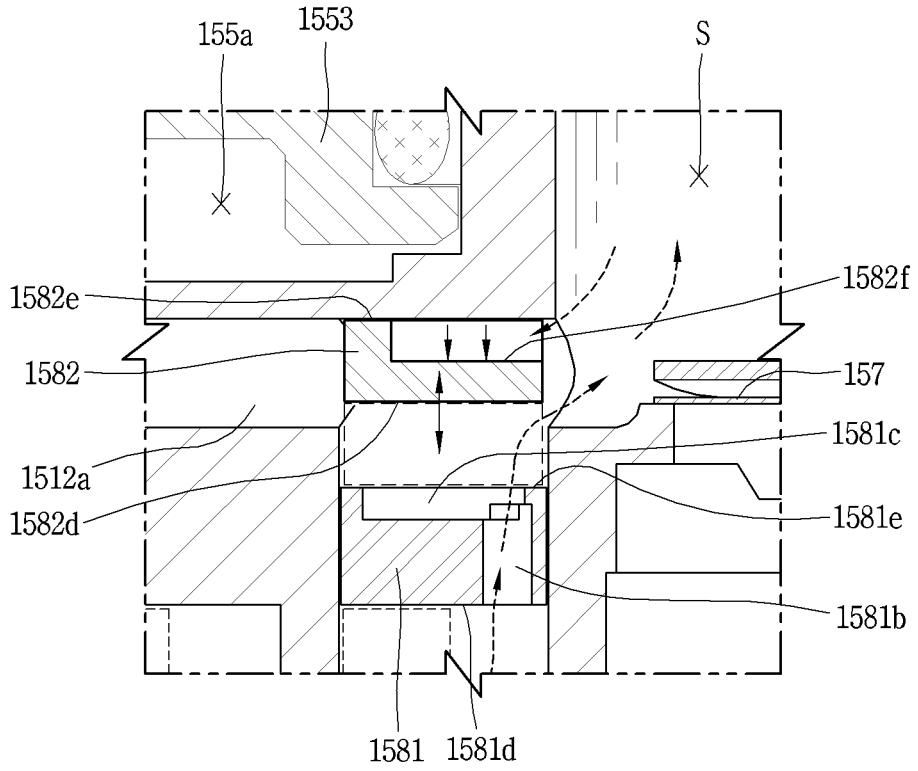
FIGS. 20 and 21 are cross-sectional views showing still other embodiments of a bypass valve in FIG. 14.
Figure 21:
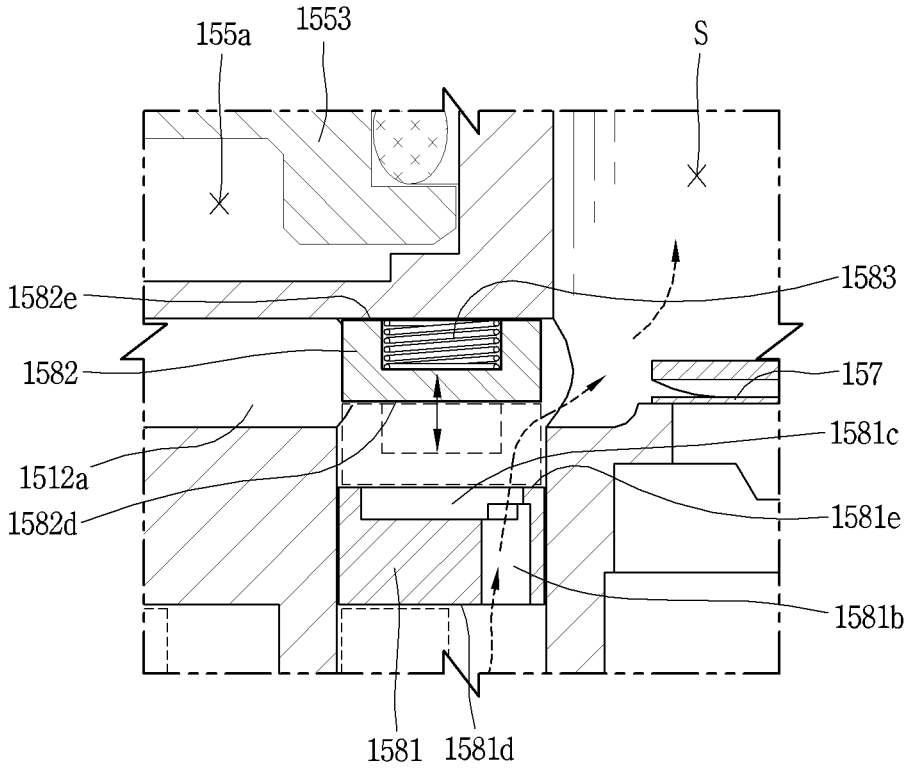

In addition to this, the bypass valve may be provided in various ways. FIG. 18 is an exploded perspective view showing another embodiment of a bypass valve in FIG. 14, FIG. 19 is a cross-sectional view showing an operation of the bypass valve in FIG. 18, and FIGS. 20 and 21 are cross-sectional views showing still other embodiments of a bypass valve in FIG. 14.

Figure 19:
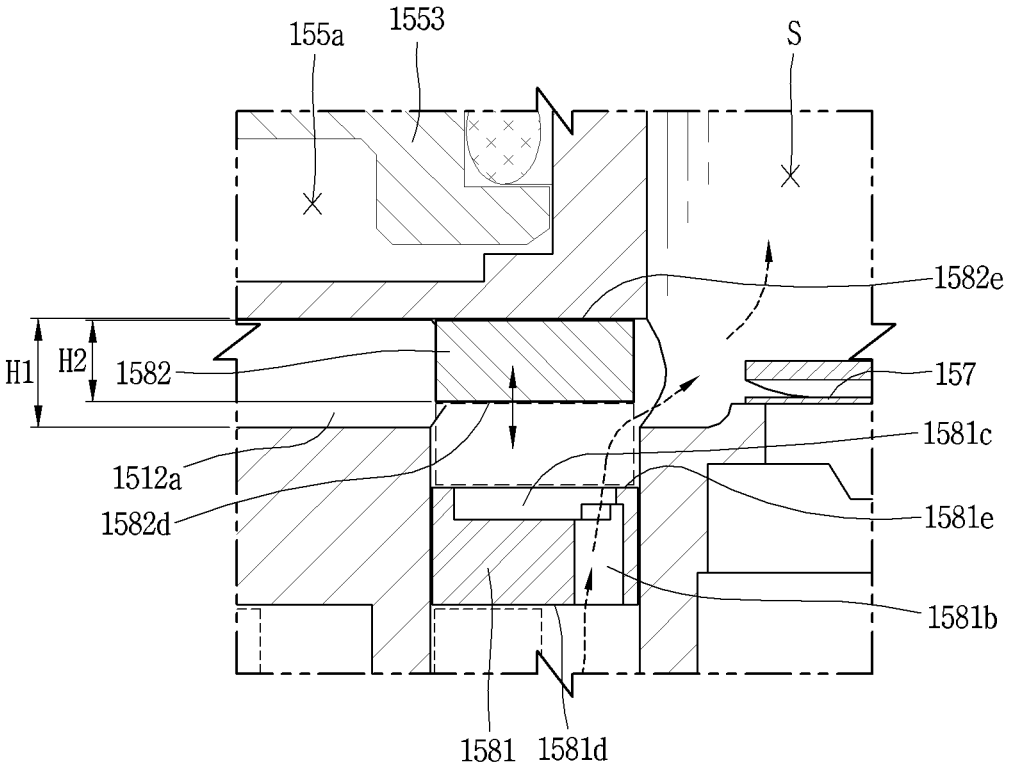
FIG. 19 is a cross-sectional view showing an operation of the bypass valve in FIG. 18.

Referring to FIGS. 18 and 19, the first bypass valve 158*a* may include a first fixed member 1581 and a first valve member 1582, and a discharge passage may be provided only in the first fixed member 1581. For example, a first fixed discharge passage 1581*a* including a first fixed discharge port 1581*b* and a first fixed discharge recess 1581*c* is provided in the first fixed member 1581, and the first valve member 1582 may be provided in a block shape.

Specifically, as in the embodiments described above, the first fixed discharge port 1581*b* is provided of a plurality of holes penetrated in the axial direction of the first fixed member 1581, and the first fixed discharge recess 1581*c* may be provided as a recess having a preset depth to communicate with the first fixed discharge port 1581*b* by allowing the plurality of holes to communicate with each other in the second side surface 1581*e* of the first fixed member 1581. However, the first fixed discharge recess 1581*c* according to the present embodiment may be provided in a circular cross-sectional shape unlike the embodiment described above.

The first valve member 1582 may be provided in a simple block shape as described above, that is, both the first side surface 1582*d* and the second side surface 1582*e* may be provided to have a flat plate shape. However, in this case, as for the axial thickness H2 of the first valve member 1582, only when the first side surface of the first valve member 1582 is located to be higher than the lower surface of the first communicating recess portion 1554*a* in a state in which the first valve member 1582 reaches or almost reaches the upper surface of the first communicating recess portion 1554*a*, the upper end of the first bypass hole 1512*a* may be opened and the compression chamber V and the discharge chamber S may communicate with each other through the first communicating recess portion 1554*a*. Accordingly, it is preferable that the axial thickness H2 of the first valve member 1582 is smaller than the axial height H2 of the first communicating recess portion 1554*a*.

Although not shown in the drawings, a first discharge recess (not shown) having a preset depth may be provided on the first side surface 1582*d* of the first valve member 1582 facing the first fixed member 1581. In this case, if the depth at which the first discharge recess (not shown) is blocked with respect to the discharge chamber S in a closed state, the axial thickness H2 of the first valve member 1582 may be provided to be greater than the axial height H1 of the first communicating recess portion 1554*a*.

In addition, when both the first side surface 1582*d* and the second side surface 1582*e* of the first valve member 1582 are provided in a flat plate shape as described above, the closing operation of the first valve member 1582 may be delayed. Accordingly, as shown in FIG. 20, a first pressing recess 1582*f* may be further provided in the second side surface 1582*e* of the first valve member 1582. Accordingly, when the first valve member 1582 is opened and closed, the first valve member 1582 may be quickly moved in the closing direction by the self-load of the first valve member 1582 and the pressure of the refrigerant flowing into the first pressing recess 1582*f* Through this, a backflow of the refrigerant in the discharge chamber S to the compression chamber V may be effectively suppressed.

In addition, as shown in FIG. 21, an elastic member 1583 such as a coil spring may be further provided between the second side surface 1582*e* of the first valve member 1582 and the upper surface of the first communicating recess portion 1554*a* facing the first valve member 1582. Accordingly, even if the first valve member 1582 is provided in a flat plate shape, the first valve member 1582 may move quickly in the closing direction by the self-load of the first valve member 1582 and a restoring force of the elastic member 1583. Through this, a backflow of the refrigerant in the discharge chamber S to the compression chamber V may be effectively suppressed.

Meanwhile, another embodiment of the back pressure chamber including the bypass valve is as follows.

That is, in the above embodiment, the bypass valve may be installed inside the back pressure chamber inner wall or inserted into the bypass hole, but in some cases, the bypass valve may be installed outside the bypass hole from the outside of the back pressure chamber inner wall.

Figure 22:
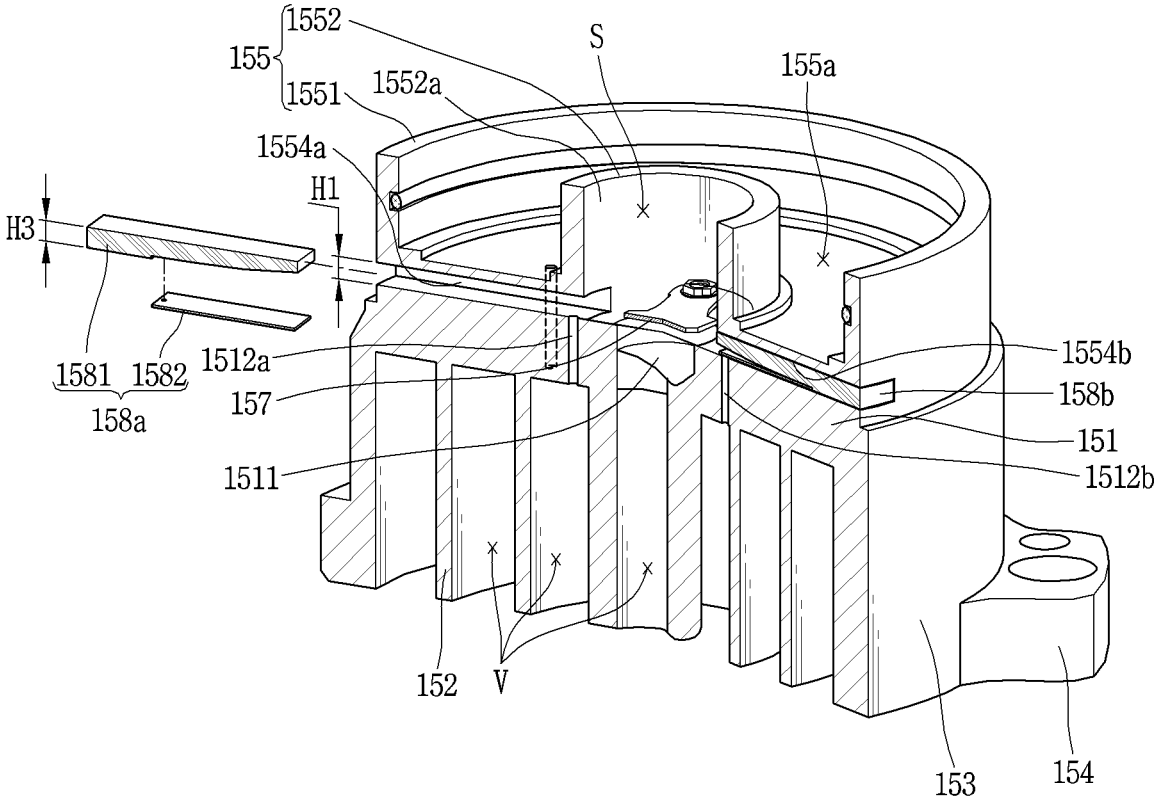
FIG. 22 is an exploded perspective view of another embodiment of a back pressure chamber part in FIG. 1.
Figure 23:
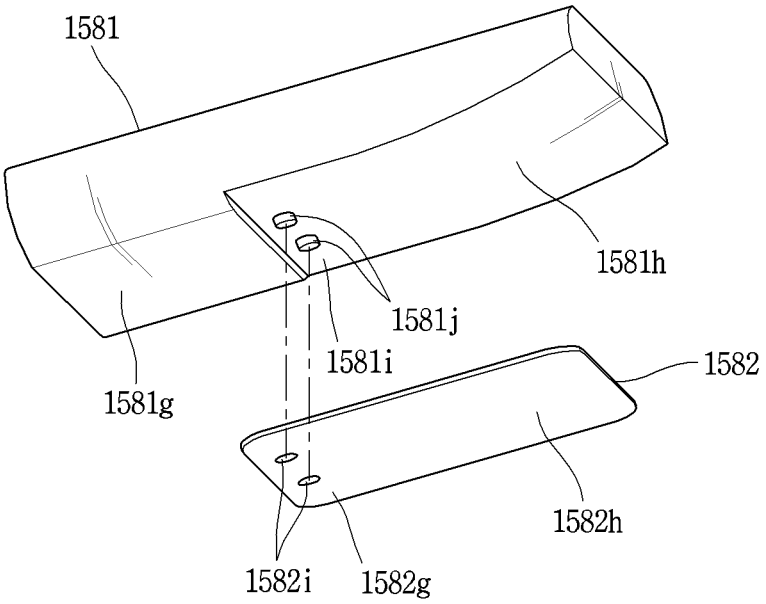
FIG. 23 is an exploded perspective view of a bypass valve in FIG. 22.
Figure 24:
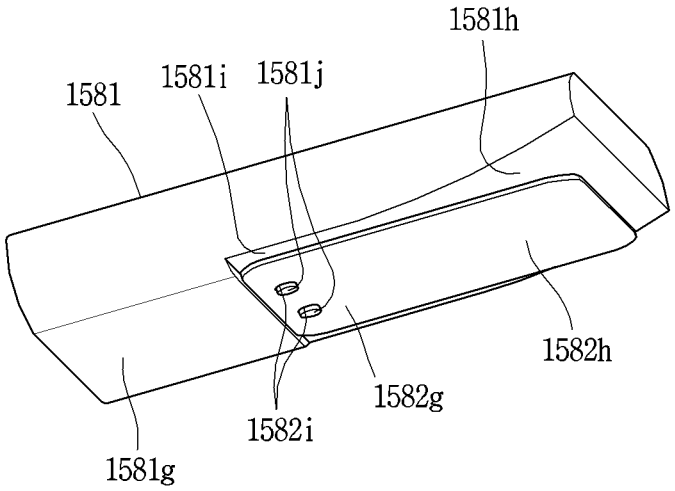
FIG. 24 is an assembly perspective view of FIG. 23.
Figure 25:
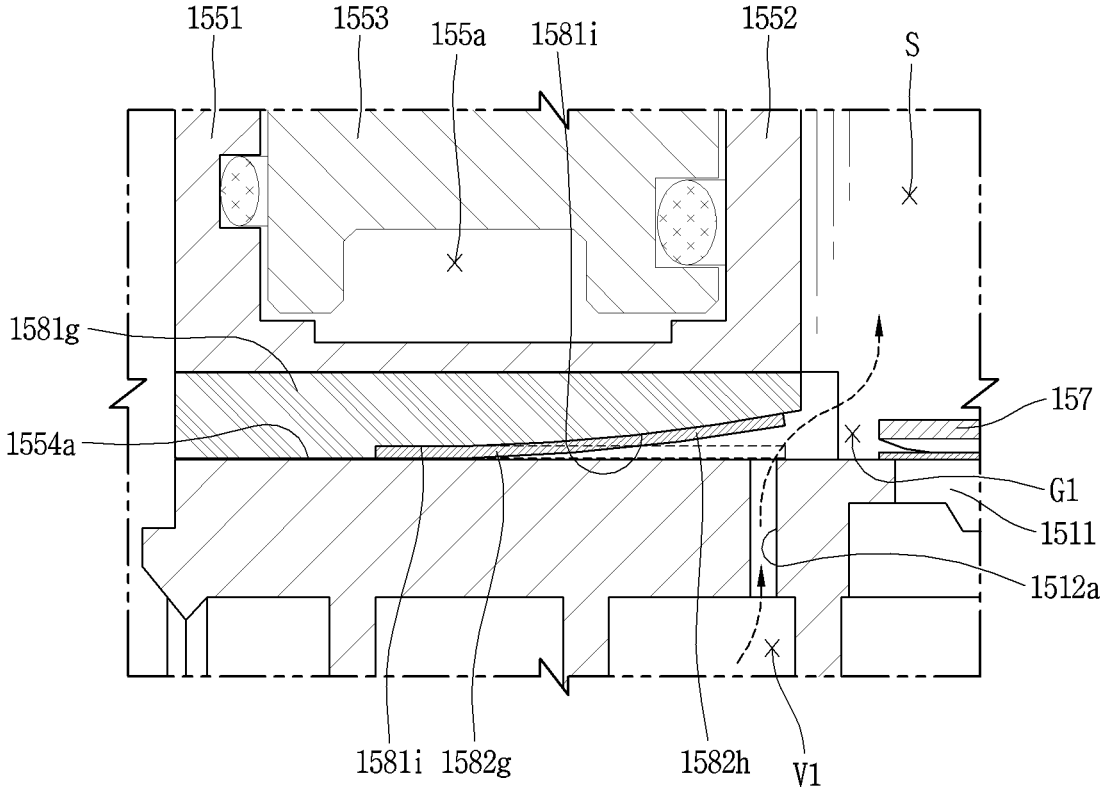
FIG. 25 is a cross-sectional view illustrating an operation of a bypass valve in FIG. 22.

FIG. 22 is an exploded perspective view of another embodiment of the back pressure chamber in FIG. 1, FIG. 23 is an exploded perspective view of the bypass valve in FIG. 22, FIG. 24 is an assembled perspective view of FIG. 23, and FIG. 25 is a cross-sectional view showing an operation of the bypass valve.

Referring to FIGS. 22 to 25, a basic configuration of the back pressure chamber part 155 according to the present embodiment and the effects thereof are similar to those of the embodiment described above. Accordingly, the description of the basic configuration of the back pressure chamber part 155 and the effect thereof will be replaced with the description of the embodiment described above. However, the bypass holes 1512*a* and 1512*b* according to the present embodiment may be provided on an inner side than the inner circumferential surface 1552*a* of the back pressure chamber inner wall 1552 or may be provided at a position overlapping the back pressure chamber inner wall 1552 in the axial direction. This embodiment will be mainly described with reference to an example in which the bypass holes 1512*a* and 1512*b* are provided at positions overlapping the back pressure chamber inner wall 1552 in the axial direction.

The first communicating recess portion 1554*a* according to the present embodiment may be provided similarly to the embodiment shown in FIGS. 14 to 21 described above. In other words, the first communicating recess portion 1554*a* may independently communicate with the first bypass hole 1512*a*. Accordingly, the description of the basic configuration of the first communicating recess portion 1554*a* and the effect thereof will be replaced with the description of the embodiment shown in FIGS. 14 to 21 described above.

However, in the embodiment described above, since the first communicating recess portion 1554*a* acts only as a communication passage connecting the first bypass hole 1512*a* and the discharge chamber S, a shape of the first communicating recess portion 1554*a* may be provided regardless of the shape of the first bypass valve 158*a*.

However, in this embodiment, as the first bypass valve 158*a* is inserted and installed in the first communicating recess portion 1554*a*, the shape of the first communicating recess portion 1554*a* may correspond to the shape of the first bypass valve 158*a*. Accordingly, in the present embodiment, a stopper member for blocking the first communicating recess portion 1554*a* may be removed.

For example, the first bypass valve 158*a* according to the present embodiment may be provided of a kind of modular reed valve having a substantially rectangular cross-sectional shape. Accordingly, the first communicating recess portion 1554*a* may be provided in a substantially rectangular cross-sectional shape like the first bypass valve 158*a*.

In other words, a circumferential width of the first communicating recess portion 1554*a* may be greater than a circumferential width of the first bypass hole 1512*a*, and the axial height H1 of the first communicating recess portion 1554*a* may be provided to be equal to an axial thickness of the first fixed member 1581 forming a portion of the first bypass valve 158*a*, that is, the axial thickness H3 of the first fixed member 1581*g* of the first fixed member 1581 to be described later. Accordingly, the first bypass valve 158*a* constituting the modular reed valve may be inserted and fixed into the first communicating recess portion 1554*a*, and at the same time, the first opening/closing portion 1582*h* of the first valve member 1582 to be described later may stably open and close the first bypass hole 1512*a*. This is also the same for the second bypass valve. In other words, since the first bypass valve 158*a* and the second bypass valve 158*b* are almost identical in this embodiment as well, the following description will focus on the first bypass valve 158*a*, but the description of the second bypass valve 158*b* is replaced with the description of the first bypass valve 158*a*.

Referring to FIGS. 23 and 24, the first bypass valve 158*a* according to the present embodiment includes a first fixed member 1581 and a first valve member 1582. The first valve member 1582 is fixedly coupled to the first fixed member 1581, and the first fixed member 1581 is inserted into and fixed to the first communicating recess portion 1554*a*. Accordingly, the first bypass valve 158*a* forms a modular valve.

In addition, a radial length of the first fixed member 1581 may be provided to be shorter than the radial length of the first communicating recess portion 1554*a*. Accordingly, a first communication gap G1 connecting the first bypass hole 1512*a* and the discharge chamber S is may be provided between the inner end of the first fixed member 1581 and the inner end of the first communicating recess portion 1554*a*.

Specifically, the first fixed member 1581 may be provided in a rectangular plate body, and at one end thereof, both side surfaces in the axial direction are provided to be flat, and at the other end thereof, one side surface in the axial direction may be provided to be inclined or curved. In other words, one end of the first fixed member 1581 forms a first fixed portion 1581*g* that is inserted into and fixed to the outer end of the first communicating recess portion 1554*a*, and the other end thereof is spaced apart from the first bypass hole 1512*a* by a preset interval to form a first retainer portion 1581*h*.

The first fixed portion 1581*g* is provided to be flat as described above, and the axial thickness of the first fixed portion 1581*g* is provided to be substantially the same as the axial height of the first communicating recess portion 1554*a*. Accordingly, the first fixed portion 1581*g* may be inserted into the first communicating recess portion 1554*a* to be firmly fixed. The first fixed portion 1581*g* may be fastened or welded to the non-orbiting scroll 150.

As described above, one side surface of the first retainer portion 1581*h*, that is, a lower surface facing the first valve member 1582, is provided as an inclined surface or a curved surface. For example, the first retainer portion 1581*h* may be inclined or curved such that an interval to the first valve member 1582 is increased in a direction away from the first fixed portion 1581*g*. Accordingly, the first opening/closing end portion 1582*h* of the first valve member 1582 to be described later may be rotated while being bent around a first fixed end portion 1582*g* to open and close the first bypass hole 1512*a*.

In addition, a first valve accommodating portion 1581*i*, into which the first fixed end portion 1582*g* of the first valve member 1582 to be described later is inserted is provided to be stepped in the middle of the first fixed member 1581, that is, between the first fixed portion 1581*g* and the first retainer portion 1581*h*. The depth of the first valve accommodating portion 1581*i* may be equal to or greater than the thickness of the first valve member 1582. Accordingly, the first valve member 1582 may be inserted into and coupled to the first valve accommodating portion 1581*i* of the first fixed member 1581.

In addition, at least one first valve fixed protrusion 1581*j* may be provided in the first valve accommodating portion 1581*i*. For example, when there is only one first valve fixed protrusion 1581*j*, a valve rotation preventing surface (not shown) such as a D-cut may be further provided between the first valve fixed protrusion 1581*j* and the first valve fixed hole 1582*i* so that the valve fixed hole 1582*i* of the first valve member 1582 to be described later may not run idle. Meanwhile, when there are two or more first valve fixed protrusions 1581*j*, since the first valve member 1582 does not run idle with respect to the first fixed member 1581, the first valve fixed protrusions 1581*j* and the first valve fixed holes 1582*i* may also be provided in a circle. In this embodiment, an example in which the first valve fixed protrusion 1581*j* and the first valve fixing hole 1582*i* are provided in pairs is shown.

Referring to FIGS. 23 and 24, the first valve member 1582 may be provided in a flat plate shape like the first fixed member 1581. However, the first valve member 1582 may be provided shorter than the first fixed member 1581 as one end thereof is inserted into and coupled to the first valve accommodating portion 1581*i* of the first fixed member 1581.

Specifically, the first valve member 1582 is provided as a rectangular plate body, and may be provided to have the same thickness and width as a whole. In other words, one end of the first valve member 1582 forms a first fixed end 1582*g* inserted and fixed in the first valve accommodating portion 1581*i* of the first fixed member 1581, and the other end thereof forms a first opening/closing end portion 1582*h* opening and closing the first bypass hole 1512*a*.

The first valve fixing hole 1582*i* described above may be provided at the first fixed end. The first valve fixing hole 1582*i* may be provided in a shape corresponding to the first valve fixed protrusion 1581*j*, that is, a pair of two. Accordingly, the first valve member 1582 may be stably supported without running idle with respect to the first fixed member 1581.

The first opening/closing end 1582*h* may be provided to have a width capable of opening and closing the first bypass hole 1512*a*. For example, in consideration of the fact that the first bypass hole 1512*a* is provided as a plurality of small holes extending along the wrap, the first opening/closing end portion 1582*h* may be provided wider than a maximum distance between the plurality of small holes.

Although not shown in the drawings, the first valve member 1582 may be provided in various shapes other than a rectangle. For example, it may be depressed in a width direction between the first fixed end portion 1582*i* and the first opening/closing end portion 1582*h*, or at least one hole may be provided. In this case, as the width between the first fixed end 1582*i* and the first opening/closing end 1582*h* is narrowed, the first valve member 1582 may open and close the first bypass hole 1512*a* more rapidly to effectively suppress overcompression of the compressed refrigerant and a backflow of the discharged refrigerant.

As described above, the effect of the first bypass valve 158*a* according to the present embodiment is similar to that of the embodiment shown in FIGS. 14 to 21 described above. In other words, also in this embodiment, as the first communicating recess portion 1554*a* is provided to penetrate radially from the outer circumferential surface of the non-orbiting scroll 150 toward the discharge chamber S, the first communicating recess portion 1554*a* communicating with the first bypass hole 1512*a* may be easily provided by a required depth.

However, in this embodiment, as the first bypass valve 158*a* is provided as a modular reed valve, the structure of the first bypass valve 158*a* is simplified and the first bypass valve 158*a* may be easily assembled to the first communicating recess portion 1554*a*, so that the manufacturing costs of the first bypass valve 158*a* may be reduced.

In addition, as the first valve member 1582 is provided of a reed valve having elasticity, a valve response speed and operation reliability may be improved.

In addition, since the first bypass valve 158*a* is inserted and fixed into the first communicating recess portion 1554*a* penetrated in the radial direction, there is no need for a separate stopper member for blocking the first communicating recess portion 1554*a* as described above. Through this, the manufacturing process may be simplified and a dead volume in the first communicating recess portion 1554*a* may be reduced.

Meanwhile, in the embodiment described above, a case in which the discharge valve is a reed valve has been described as an example, but in some cases, the discharge valve may be provided of a piston valve. Also in this case, the back pressure chamber including the bypass valve may be provided to be the same as in the embodiment described above. Since a basic configuration or effect thereof is similar to those of the embodiment described above, a description thereof will be replaced with the description of the embodiment described above.

Meanwhile, although not shown in the drawings, the back pressure chamber part may be provided by post-assembling a separate back pressure chamber assembly including the back pressure chamber outer wall, the back pressure chamber inner wall, and the floating plate to the non-orbiting scroll. In this case, bypass holes communicating with each other may be provided in the non-orbiting scroll and the back pressure chamber assembly, and a communicating recess portion penetrating between the bypass hole and the back pressure chamber inner wall may be provided. The bypass valve described above may be installed outside the bypass hole, inside the bypass hole, or inside the communicating recess portion.

What is claimed is:

1. A scroll compressor comprising:

an orbiting scroll including an orbiting wrap positioned at a surface of an orbiting end plate, the orbiting scroll being coupled to a rotation shaft; and a non-orbiting scroll including:

a non-orbiting wrap positioned at a surface of a non-orbiting end plate, the non-orbiting wrap being configured to engage the orbiting wrap to thereby define a compression chamber, a back pressure chamber part defining a back pressure chamber at an opposite surface of the non-orbiting end plate, and a discharge chamber defined at the back pressure chamber part and being in fluid communication with the compression chamber, wherein a discharge port is defined at the non-orbiting scroll and enables fluid communication between the compression chamber and the discharge chamber, and wherein a bypass hole is defined around the discharge port and enables fluid communication between a first portion of the compression chamber and the discharge chamber, the first portion of the compression chamber having a pressure lower than a pressure of a second portion of the compression chamber that is in fluid communication with the discharge port, wherein a communicating recess portion is provided at an inner circumferential surface of the discharge chamber and enables fluid communication between the discharge chamber and the bypass hole, wherein a bypass valve is provided inside the bypass hole and configured to open and close the bypass hole, wherein the bypass valve includes:

a fixed member inserted into the bypass hole, and a valve member located between the fixed member and the communicating recess portion and configured to, based on a pressure difference between the compression chamber and the discharge chamber, move in an axial direction and be detachably attached to the fixed member to thereby selectively open and close the bypass hole, wherein a fixed discharge passage is provided at the fixed member and extends in the axial direction, wherein a valve discharge passage is provided at the valve member and configured to be selectively in fluid communication with the fixed discharge passage, wherein the valve discharge passage includes:

a valve discharge port penetrating from a first side of the valve member facing the fixed member to a second side of the valve member, and a valve discharge recess extending from the valve discharge port to an outer circumferential surface of the valve member toward the discharge chamber, and wherein an axial thickness of the valve member is greater than or equal to an axial height of the communicating recess portion.

2. The scroll compressor of claim 1, wherein a back pressure chamber outer wall and a back pressure chamber inner wall extend from the opposite surface of the non-orbiting end plate and define the back pressure chamber, wherein the communicating recess portion is provided in an annular shape on an inner circumferential surface of the back pressure chamber inner wall constituting the discharge chamber, and an outer diameter of the communicating recess portion is greater than an inner diameter of the back pressure chamber inner wall, and wherein a back pressure hole is defined at the non-orbiting end plate and enables fluid communication between the compression chamber and the back pressure chamber, the back pressure hole being located at an outer side than the communicating recess portion.

3. The scroll compressor of claim 1, wherein a back pressure chamber outer wall and a back pressure chamber inner wall extend from the opposite surface of the non-orbiting end plate and define the back pressure chamber, and wherein the communicating recess portion extends linearly at an inner circumferential surface of the back pressure chamber inner wall defining the discharge chamber, the communicating recess portion extending between an outer circumferential surface of the non-orbiting scroll and the inner circumferential surface of the back pressure chamber inner wall, and wherein a back pressure hole is defined at the non-orbiting end plate and enables fluid communication between the compression chamber and the back pressure chamber, the back pressure hole being defined at a side of the communicating recess portion in a circumferential direction.

4. The scroll compressor of claim 1, wherein a back pressure chamber outer wall and a back pressure chamber inner wall extend from the opposite surface of the non-orbiting end plate and define the back pressure chamber, and wherein the bypass hole is defined at an opposite side of the discharge port with respect to an inner circumferential surface of the back pressure chamber inner wall.

5. The scroll compressor of claim 4, wherein a floating plate is configured to cover a portion between the back pressure chamber outer wall and the back pressure chamber inner wall to thereby define the back pressure chamber between the back pressure chamber outer wall and the back pressure chamber inner wall, and wherein the floating plate includes:

an upper cover portion having an annular shape and defining an upper surface of the back pressure chamber, an outer cover portion extending from an outer periphery of the upper cover portion in an axial direction toward the non-orbiting scroll, and an inner cover portion extending from an inner periphery of the upper cover portion in the axial direction toward the non-orbiting scroll, and wherein an inner circumferential surface of the inner cover portion is slidably disposed at an outer circumferential surface of the back pressure chamber inner wall.

6. The scroll compressor of claim 1, wherein a back pressure chamber outer wall and a back pressure chamber inner wall extend from the opposite surface of the non-orbiting end plate and define the back pressure chamber, and wherein at least a portion of the bypass hole is provided between an inner circumferential surface of the back pressure chamber inner wall and the discharge port.

7. The scroll compressor of claim 6, wherein a floating plate is configured to cover a portion between the back pressure chamber outer wall and the back pressure chamber inner wall to thereby define the back pressure chamber between the back pressure chamber outer wall and the back pressure chamber inner wall, and wherein the floating plate includes:

an upper cover portion having an annular shape and defining an upper surface of the back pressure chamber, an outer cover portion extending from an outer periphery of the upper cover portion in an axial direction toward the non-orbiting scroll, and an inner cover portion extending from an inner periphery of the upper cover portion in the axial direction toward the non-orbiting scroll, and wherein an inner circumferential surface of the inner cover portion is slidably disposed at an outer circumferential surface of the back pressure chamber inner wall.

8. The scroll compressor of claim 1, wherein an end of the bypass valve facing the compression chamber is configured to face an axial cross-section of the orbiting wrap in an axial direction between portions of the non-orbiting wrap facing each other, and wherein at least a portion of an outer circumferential surface of the bypass valve is configured to have the same curvature as a main surface of the non-orbiting wrap.

9. The scroll compressor of claim 1, wherein an end of the bypass valve facing the compression chamber faces an axial cross-section of the orbiting wrap in an axial direction between portions of the non-orbiting wrap facing each other, and wherein a radial length of the bypass valve is the same as a distance between main surfaces of portions of the non-orbiting wrap facing each other in a radial direction.

10. The scroll compressor of claim 1, wherein the fixed discharge passage includes:

a fixed discharge port being open at a first end toward the compression chamber and extending through the fixed member in the axial direction, and wherein a fixed discharge recess is defined in the axial direction at a surface of the fixed member facing the valve member and a second end of the fixed discharge port is in fluid communication with the fixed discharge recess to be opened and closed by the valve member.

11. The scroll compressor of claim 1, wherein the fixed member has a thermal expansion coefficient greater than or equal to a thermal expansion coefficient of the non-orbiting scroll, and wherein the valve member has a lower thermal expansion coefficient and a lighter material than the fixed member.

12. The scroll compressor of claim 1, wherein the fixed discharge passage includes:

a fixed discharge port having a first end open toward the compression chamber and penetrating the fixed member in the axial direction; and a fixed discharge recess depressed in the axial direction at a side of the fixed member facing the valve member and being in fluid communication with a second end of the fixed discharge port to be opened and closed by the valve member, wherein the fixed discharge port includes a plurality of fixed discharge ports that are spaced apart from each other at a predetermined distance along a main surface of the non-orbiting wrap, and wherein the fixed discharge recess is in fluid communication with each of the plurality of fixed discharge ports.

13. The scroll compressor of claim 1, wherein the valve member has a pressing recess depressed toward the discharge chamber at an opposite side to a side facing the fixed member, or wherein the valve member includes an elastic member at the opposite side to the side facing the fixed member and configured to elastically support the valve member toward the fixed member.

14. The scroll compressor of claim 1, wherein the fixed member has a thermal expansion coefficient greater than or equal to a thermal expansion coefficient of the non-orbiting scroll, and wherein the valve member has a lower thermal expansion coefficient and is lighter than the fixed member.

15. A scroll compressor comprising:

an orbiting scroll including an orbiting wrap positioned at a surface of an orbiting end plate, the orbiting scroll being coupled to a rotation shaft; and a non-orbiting scroll including:

a non-orbiting wrap positioned at a surface of a non-orbiting end plate, the non-orbiting wrap being configured to engage the orbiting wrap to thereby define a compression chamber, a back pressure chamber part defining a back pressure chamber at an opposite surface of the non-orbiting end plate, and a discharge chamber defined at the back pressure chamber part and being in fluid communication with the compression chamber, wherein a discharge port is defined at the non-orbiting scroll and enables fluid communication between the compression chamber and the discharge chamber, wherein a bypass hole is defined around the discharge port and enables fluid communication between a first portion of the compression chamber and the discharge chamber, the first portion of the compression chamber having a pressure lower than a pressure of a second portion of the compression chamber that is in fluid communication with the discharge port, wherein a communicating recess portion is provided at an inner circumferential surface of the discharge chamber and enables fluid communication between the discharge chamber and the bypass hole, wherein a bypass valve is provided inside the bypass hole and configured to open and close the bypass hole, wherein the bypass valve includes:

a fixed member inserted into the bypass hole, and a valve member located between the fixed member and the communicating recess portion and configured to, based on a pressure difference between the compression chamber and the discharge chamber, move in an axial direction and be detachably attached to the fixed member to thereby selectively open and close the bypass hole, wherein a fixed discharge passage is provided at the fixed member and extends in the axial direction, wherein a valve discharge passage is provided at the valve member and configured to be selectively in fluid communication with the fixed discharge passage, wherein the fixed discharge passage includes:

a fixed discharge port being open at a first end toward the compression chamber and extending through the fixed member in the axial direction, wherein a fixed discharge recess is defined in the axial direction at a surface of the fixed member facing the valve member and a second end of the fixed discharge port is in fluid communication with the fixed discharge recess to be opened and closed by the valve member, wherein the fixed discharge port includes a plurality of fixed discharge ports that are spaced apart from each other at a predetermined distance along a main surface of the non-orbiting wrap, wherein the fixed discharge recess has an annular shape, each of the plurality of fixed discharge ports being in fluid communication with the fixed discharge recess, and wherein, in the fixed member, an opening/closing protrusion is provided along a same axial line as the valve discharge passage and configured to open and close the valve discharge passage, the opening/closing protrusion having a same height as a surface of the fixed member facing the valve member inside the fixed discharge recess.

16. A scroll compressor comprising:

an orbiting scroll including an orbiting wrap positioned at a surface of an orbiting end plate, the orbiting scroll being coupled to a rotation shaft; and a non-orbiting scroll including:

a non-orbiting wrap positioned at a surface of a non-orbiting end plate, the non-orbiting wrap being configured to engage the orbiting wrap to thereby define a compression chamber, a back pressure chamber part defining a back pressure chamber at an opposite surface of the non-orbiting end plate, and a discharge chamber defined at the back pressure chamber part and being in fluid communication with the compression chamber, wherein a discharge port is defined at the non-orbiting scroll and enables fluid communication between the compression chamber and the discharge chamber, wherein a bypass hole is defined around the discharge port and enables fluid communication between a first portion of the compression chamber and the discharge chamber, the first portion of the compression chamber having a pressure lower than a pressure of a second portion of the compression chamber that is in fluid communication with the discharge port, wherein a communicating recess portion is provided at an inner circumferential surface of the discharge chamber and enables fluid communication between the discharge chamber and the bypass hole, wherein a bypass valve is provided inside the bypass hole and configured to open and close the bypass hole, wherein the bypass valve includes:

a fixed member inserted into the bypass hole, and a valve member located between the fixed member and the communicating recess portion and configured to, based on a pressure difference between the compression chamber and the discharge chamber, move in an axial direction and be detachably attached to the fixed member to thereby selectively open and close the bypass hole, wherein a fixed discharge passage is provided at the fixed member and extends in the axial direction, wherein a valve discharge passage is provided at the valve member and configured to be selectively in fluid communication with the fixed discharge passage, wherein the valve discharge passage includes:

a valve discharge port penetrating from a first side of the valve member facing the fixed member to a second side of the valve member, and a valve discharge recess extending from the valve discharge port to an outer circumferential surface of the valve member toward the discharge chamber, and wherein the valve discharge recess is depressed in the axial direction from the second side of the valve member.

* * * * *